US012520941B1

(12) United States Patent
Zhou et al.

(10) Patent No.: US 12,520,941 B1
(45) Date of Patent: Jan. 13, 2026

(54) SEAT BRACKET AND ZERO-WALL-GAP SEAT WITH SEAT BRACKET

(71) Applicant: DewertOkin Technology Group Co., Ltd., Zhejiang (CN)

(72) Inventors: Weiyao Zhou, Zhejiang (CN); Liming Yang, Zhejiang (CN); Qiqi Ye, Zhejiang (CN)

(73) Assignee: DewertOkin Technology Group Co., Ltd., Jiaxing (CN)

( * ) Notice: Subject to any disclaimer, the term of this patent is extended or adjusted under 35 U.S.C. 154(b) by 0 days.

(21) Appl. No.: 19/247,489

(22) Filed: Jun. 24, 2025

Related U.S. Application Data

(63) Continuation-in-part of application No. 19/062,771, filed on Feb. 25, 2025.

(30) Foreign Application Priority Data

| | | |
|---|---|---|
| Jul. 19, 2024 | (CN) | 202410976230.5 |
| Jul. 19, 2024 | (CN) | 202421729715.6 |
| Aug. 24, 2024 | (CN) | 202422064560.5 |

(51) Int. Cl.

| | |
|---|---|
| ***A47C 1/032*** | (2006.01) |
| ***A47C 1/034*** | (2006.01) |
| ***A47C 1/035*** | (2006.01) |
| ***A47C 1/0355*** | (2013.01) |
| ***A47C 7/50*** | (2006.01) |

(52) U.S. Cl.
CPC ..... *A47C 1/0355* (2013.01)

(58) Field of Classification Search
CPC . A47C 1/0355; A47C 1/03211; A47C 1/0242; A47C 1/0345
See application file for complete search history.

(56) References Cited

U.S. PATENT DOCUMENTS

| | | | | |
|---|---|---|---|---|
| 7,396,074 | B2 * | 7/2008 | Wiecek | A47C 1/0355 297/85 L |
| 11,517,109 | B2 * | 12/2022 | Browning | A47C 1/03211 |
| 11,617,446 | B2 * | 4/2023 | Zhang | A47C 7/5068 297/423.26 |

(Continued)

FOREIGN PATENT DOCUMENTS

| | | |
|---|---|---|
| WO | 2014067217 A1 | 5/2014 |

OTHER PUBLICATIONS

Extended European search report dated Jul. 28, 2025 received in European Patent Application No. 25159840.5.

*Primary Examiner* — Shin H Kim
(74) *Attorney, Agent, or Firm* — Scully, Scott, Murphy & Presser, P.C.

(57) ABSTRACT

A seat bracket and a zero-wall-gap seat with the seat bracket are provided. The seat bracket includes: a base; a linkage assembly including a bracket side plate and a linkage assembly, wherein the linkage assembly is hinged with the base and the bracket side plate is hinged on the linkage assembly; and a backrest mechanism including a backrest mounting plate, a backrest pivoting assembly and a limiting plate, wherein the backrest pivoting assembly includes a first front backrest connecting rod, a second front backrest connecting rod and a rear backrest connecting rod; and the backrest mounting plate has a reclined position tilted backwards relative to the base and a reset position reset relative to the base.

20 Claims, 15 Drawing Sheets

(56) References Cited

U.S. PATENT DOCUMENTS

| | | | | |
|---|---|---|---|---|
| 11,690,453 | B2 * | 7/2023 | Zhang | A47C 1/032 297/330 |
| 11,700,942 | B2 * | 7/2023 | Li | A47C 17/04 297/85 R |
| 11,766,124 | B2 * | 9/2023 | Crawford | A47C 1/0355 297/85 R |
| 11,903,485 | B1 * | 2/2024 | Lawson | A47C 1/0355 |
| 11,944,199 | B2 * | 4/2024 | Li | A47C 1/035 |
| 11,992,125 | B2 * | 5/2024 | Murphy | A47C 1/03211 |
| 12,082,698 | B2 * | 9/2024 | Liu | A47C 1/0345 |
| 12,252,059 | B2 * | 3/2025 | King | B60P 3/34 |
| 2012/0049606 | A1 * | 3/2012 | Lawson | A47C 1/0355 74/521 |
| 2018/0027967 | A1 * | 2/2018 | Lawson | A47C 1/0355 |
| 2018/0027968 | A1 * | 2/2018 | Lawson | A47C 1/0355 |
| 2020/0275781 | A1 * | 9/2020 | Lawson | A47C 3/029 |
| 2022/0324370 | A1 * | 10/2022 | King | B60P 3/34 |
| 2024/0032693 | A1 * | 2/2024 | Liu | A47C 1/0242 |
| 2024/0215726 | A1 * | 7/2024 | Li | A47C 1/0345 |
| 2025/0057317 | A1 * | 2/2025 | Zhou | A47C 17/86 |

* cited by examiner

SEAT BRACKET AND ZERO-WALL-GAP SEAT WITH SEAT BRACKET

The present application claims the priority to and benefits of U.S. application Ser. No. 19/062,771, filed to the US Patent Office on Feb. 25, 2025, entitled "Seat Bracket and Zero-Wall-Gap Seat with Seat Bracket", the disclosure of which is hereby incorporated by reference in its entirety.

CROSS-REFERENCE TO RELATED APPLICATIONS

The disclosure claims priority to the following three patent applications:

1. priority to Chinese Patent Application No. 202422064560.5, filed to the China National Intellectual Property Administration on Aug. 26, 2024 and entitled "Seat Bracket and Zero-Wall-Gap Seat With Seat Bracket";
2. priority to Chinese Patent Application No. 202411116328.X, filed to the China National Intellectual Property Administration on Aug. 14, 2024 and entitled "Stretching Device and Sofa"; and
3. priority to Chinese Patent Application No. 202421971585.7, filed to the China National Intellectual Property Administration on Aug. 14, 2024 and entitled "Stretching Device and Sofa".

TECHNICAL FIELD

The present disclosure relates to the technical field of furniture, and in particular, to a seat bracket and a zero-wall-gap seat with the seat bracket.

BACKGROUND

A movable sofa is a common furniture in life, allowing people to adjust their postures as needed. The movable sofa usually comprises three sitting positions: a lying position, a TV position and a sitting position. The movable sofa has legs, a seat, and a backrest. Cushions are disposed on corresponding structures to form structures such as a cushioned seat, a cushioned backrest and a cushioned footrest of the sofa. In the sitting position, the legs are folded, and the seat is approximately in a horizontal state while the backrest is approximately in a vertical state. In the TV position, also referred to as a television position, the legs are unfolded forwards, and the backrest substantially remains unchanged. In the lying position, the backrest is reclined and the legs substantially remain unchanged for a person to take a rest.

However, in the unfolding process of the movable sofa, since the backrest part is reclined, it is possible that a gap is formed at the junction of the backrest part and the seat part, and the presence of the gap may result in an item falling therein or a risk of pinching, thereby affecting the use and the experience of the sofa.

SUMMARY

The present disclosure provides a seat bracket and a zero-wall-gap seat with the seat bracket to solve the problem of poor use experience of a movable sofa in the related art.

According to one aspect of the present disclosure, there is provided a seat bracket including: a base; a linkage assembly including a bracket side plate and a linkage assembly, wherein the linkage assembly is hinged with the base and the bracket side plate is hinged on the linkage assembly; and a backrest mechanism including a backrest mounting plate, a backrest pivoting assembly and a limiting plate, wherein the backrest pivoting assembly includes a first front backrest connecting rod, a second front backrest connecting rod and a rear backrest connecting rod; a lower end of the first front backrest connecting rod is hinged with the bracket side plate; an upper end of the first front backrest connecting rod is hinged with a lower end of the second front backrest connecting rod; an upper end of the second front backrest connecting rod is hinged with a front end of the backrest mounting plate; a lower end of the rear backrest connecting rod is hinged with the linkage assembly; and an upper end of the rear backrest connecting rod is hinged with a rear end of the backrest mounting plate; wherein the backrest mounting plate has a reclined position tilted backwards relative to the base and a reset position reset relative to the base; and the limiting plate is capable of forming a four-connecting rod mechanism with the backrest pivoting assembly and/or the bracket side plate to limit a motion range of the backrest mounting plate between the reclined position and the reset position.

In some embodiments, the limiting plate includes a first pivoting plate; a front end of the first pivoting plate is hinged with the bracket side plate; and a rear end of the first pivoting plate is hinged with the rear backrest connecting rod.

In some embodiments, the limiting plate also includes a second pivoting plate; a front end of the second pivoting plate is hinged with the second front backrest connecting rod; a rear end of the second pivoting plate is hinged with the rear backrest connecting rod; and a rear end of the first pivoting plate is located below the rear end of the second pivoting plate.

In some embodiments, the backrest pivoting assembly also includes a limit pin disposed on the second front backrest connecting rod; when the backrest mounting plate is in the reclined position, the limit pin is abutted against the backrest mounting plate; and when the backrest mounting plate is located in the reset position, the limit pin is abutted against the second pivoting plate.

In some embodiments, the backrest pivoting assembly also includes a limit pin disposed on the rear backrest connecting rod; a sliding groove is provided in an end of the backrest mounting plate facing the rear backrest connecting rod; when the backrest mounting plate is in the reclined position, the limit pin is abutted against a lower end face of the sliding groove; and when the backrest mounting plate is located in the reset position, the limit pin is abutted against an upper end face of the sliding groove.

In some embodiments, the seat bracket also includes an anti-forward-leaning mechanism that includes a first anti-forward-leaning rod and a second anti-forward-leaning rod, wherein an upper end of the first anti-forward-leaning rod is hinged with an upper end of the second anti-forward-leaning rod; a middle of the first anti-forward-leaning rod is hinged with a front end of the linkage assembly; a lower end of the second anti-forward-leaning rod is hinged with the base; and when the backrest mounting plate is in the reclined position, a lower end of the first anti-forward-leaning rod is in contact with a ground.

In some embodiments, when the backrest mounting plate is in the reclined position, an included angle between the second front backrest connecting rod and a seat frame mounting surface of the bracket side plate is between 40° and 70°.

In some embodiments, when the backrest mounting plate is in the reclined position, a distance between the front end of the backrest mounting plate and a lower surface of the base is between 260 mm and 300 mm.

In some embodiments, the linkage assembly includes a first linkage plate, a second linkage plate, a third linkage plate, a fourth linkage plate and a fifth linkage plate; a lower end of the first linkage plate is hinged with the base; an upper end of the first linkage plate is hinged with a front end of the second linkage plate; a rear end of the second linkage plate is hinged with the bracket side plate; a front end of the third linkage plate is hinged with a middle of the second linkage plate; a rear end of the third linkage plate is hinged with a front end of the fourth linkage plate; a lower end of the fourth linkage plate is hinged with a lower end of the bracket side plate; a rear end of the fourth linkage plate is hinged with the rear backrest connecting rod; an upper end of the fourth linkage plate is hinged with an upper end of the fifth linkage plate; and a lower end of the fifth linkage plate is hinged with the base.

In some embodiments, the seat bracket also includes a driving mechanism, the driving mechanism includes a driving member, a slider, a driving connecting rod and a driving rod, wherein the driving member is in driving connection with the slider to drive the slider to move along a front-rear direction of the base; the driving connecting rod extends along the front-rear direction of the base; the driving rod extends along a left-and-right direction of the base; the slider is hinged with a lower end of the driving connecting rod; an upper end of the driving connecting rod is hinged with the driving rod; the driving rod is in driving connection with the bracket side plate; in a process of the driving member driving the slider to slide, the slider is capable of driving the driving connecting rod to rotate, thereby moving the driving rod forwards and upwards; the driving rod drives, by means of the bracket side plate and the linkage assembly, the backrest mounting plate to move from the reset position to the reclined position; and/or a footstool assembly, the footstool assembly includes an inner stool plate, an outer stool plate, a front stool plate, a rear stool plate, a first front stool connecting rod, a second front stool connecting rod, a rear stool connecting rod, a front footstool and a rear footstool, wherein a rear end of the outer stool plate is hinged with the bracket side plate; a front end of the outer stool plate is hinged with a rear end of the rear stool plate; a rear end of the inner stool plate is hinged with the bracket side plate; a front end of the inner stool plate is hinged with a rear end of the front stool plate; a middle of the inner stool plate is hinged with a middle of the rear stool plate; a rear end of the first front stool connecting rod is hinged with the middle of the rear stool plate; a middle of the first front stool connecting rod is hinged with a middle of the front stool plate; a front end of the first front stool connecting rod is hinged with a rear end of the second front stool connecting rod; the front footstool is connected with a front end of the front stool plate and a front end of the second front stool connecting rod, respectively; a lower end of the rear stool connecting rod is hinged with a middle of the second front stool connecting rod; and the rear footstool is separately hinged with a front end of the rear stool plate and an upper end of the rear stool connecting rod.

In some embodiments, the seat bracket includes two linkage mechanisms, wherein the base is disposed on a horizontal mounting base surface, and the two linkage mechanisms are disposed on two opposite sides of the base, respectively; the bracket side plate is configured to be connected with a seat frame of a zero-wall-gap seat; the seat bracket further includes a footstool assembly; the footstool assembly and the backrest mechanism are both movably connected with the bracket side plate; the footstool assembly includes a footrest; the backrest mounting plate is configured to be connected with a backrest cushion of the zero-wall-gap seat; the seat bracket has a sitting position, a TV position and a lying position; the bracket side plates of each of the two linkage mechanisms is disposed movably such that the seat bracket can be reciprocally switched between the sitting position, the TV position and the lying position; wherein when the seat bracket is in the sitting position, the footrest is retracted below the seat frame, and a minimum distance between a highest point of the backrest cushion and a preset vertical plane is equal to zero; when the seat bracket is in the TV position, the footrest is stretched in front of the seat frame and tilted relative to a horizontal direction, and a distance between the highest point of the backrest cushion and the preset vertical plane is greater than zero; when the seat bracket is in the lying position, compared with the seat bracket being in the TV position, the highest point of the backrest cushion is lowered down, and the minimum distance between the highest point of the backrest cushion and the preset vertical plane is equal to zero; and a height of a highest point of the footstool assembly relative to the horizontal mounting base surface is greater than a height of a highest point of the backrest mechanism relative to the horizontal mounting base surface.

In some embodiments, when the seat bracket is in the lying position, a value range of an included angle $\theta 1$ between an upper surface of the footrest and the horizontal mounting base surface is $7° \leq \theta 1 \leq 13°$; and when the seat bracket is in the TV position, the value range of the included angle $\theta 1$ between the upper surface of the footrest and the horizontal mounting base surface is $3° \leq \theta 1 \leq 9°$.

In some embodiments, two footrests are provided, one of the two footrests is a rear footstool and the other one of the two footrests is a front footstool; a highest point of the front footstool is higher than a highest point of the rear footstool, and a height of the highest point of the rear footstool relative to the horizontal mounting base surface is greater than a height of a highest point of the backrest mounting plate relative to the horizontal mounting base surface; the value range of the included angle $\theta 1$ between the upper surface of the front footstool and the horizontal mounting base surface is $7° \leq \theta 1 \leq 12°$; and when the seat bracket is in the TV position, the value range of the included angle $\theta 1$ between the upper surface of the front footstool and the horizontal mounting base surface is $3° \leq \theta 1 \leq 7°$.

In some embodiments, when the seat bracket is in the lying position, a value range of an included angle $\beta 1$ between the backrest mounting plate and the horizontal mounting base surface is $15° \leq \beta 1 \leq 30°$; in a process of the seat bracket being switched from the sitting position to the lying position, a value range of an angle variation 51 of the included angle $\beta 1$ between the backrest mounting plate and the horizontal mounting base surface is $25° \leq \delta 1 \leq 50°$, wherein $\delta 1 = \beta 1_{sitting\ position} - \beta 1_{lying\ position}$.

In some embodiments, when the seat bracket is in the lying position, a value range of an included angle $\beta 2$ of a preset axis of the bracket side plate and the horizontal mounting base surface is $13° \leq \beta 2 \leq 19°$; when the seat bracket is in the sitting position, the value range of the included angle $\beta 2$ of the preset axis of the bracket side plate and the horizontal mounting base surface is $6° \leq \beta 2 \leq 12°$; when the seat bracket is in the TV position, the value range of the included angle $\beta 2$ of the preset axis of the bracket side plate and the horizontal mounting base surface is $10° \leq \beta 2 \leq 15°$; and in a process of the seat bracket being switched from the sitting position to the lying position, a value range of an angle variation 52 of the included angle β2 of the preset axis of the bracket side plate and the horizontal mounting base surface is 3°≤δ2≤13°.

In some embodiments, the footstool assembly includes a rear stool plate and a front stool plate; one end of the rear stool plate and one end of the front stool plate are both hinged with the bracket side plate; the other end of the rear stool plate is hinged with the rear footstool; the other end of the front stool plate is hinged with the front footstool; wherein when the seat bracket is in the lying position and the TV position respectively, a value range of a maximum distance d4 between the rear footstool and the front footstool is 210 mm≤d4≤270 mm; when the seat bracket is in the lying position, a value range of a height d5 of the highest point of the rear footstool relative to the horizontal mounting base surface is 560 mm≤d5≤600 mm; and when the seat bracket is in the TV position, the value range of the height d5 of the highest point of the rear footstool relative to the horizontal mounting base surface is 450 mm≤d5≤500 mm.

In some embodiments, when the seat bracket is in the lying position, a value range of a height d5 of the highest point of the footrest relative to the horizontal mounting base surface is 560 mm≤d5≤600 mm; and when the seat bracket is in the TV position, the value range of the height d5 of the highest point of the footrest relative to the horizontal mounting base surface is 450 mm≤d5≤500 mm.

In some embodiments, the seat bracket also includes a driving member and a driving rod, wherein the driving rod is movably penetrated through the bracket side plate; the driving rod is in transmission connection with the footstool assembly; the driving member is in driving connection with the driving rod to drive the driving rod to move such that the driving rod drive the bracket side plate to move, causing the seat bracket to reciprocally switch between the sitting position, the TV position and the lying position; wherein before the bracket side plate moves a first preset distance d1 forwards, the driving rod is disposed rotatably about an axis of the driving rod and disposed movably along the horizontal direction such that the driving rod drive the footrest to move, causing the seat bracket to switch from the sitting position to the TV position; and before the bracket side plate continues to move a second preset distance d2 forwards, the driving rod is disposed movably along the horizontal direction to drive the bracket side plate and the backrest mounting plate to move, causing the seat bracket to switch from the TV position to the lying position.

In some embodiments, the linkage assembly has a first connecting end, a second connecting end and a third connecting end; the limiting plate includes a second pivoting plate; two ends of the second pivoting plate are hinged with the second front backrest connecting rod and the rear backrest connecting rod, respectively; and an end of the rear backrest connecting rod is hinged with the third connecting end such that the bracket side plate drives, by the second front backrest connecting rod, the backrest mounting plate to move along a direction of approaching the base, causing the bracket side plate to drive, by the linkage assembly and the rear backrest connecting rod, the backrest mounting plate to move along the direction of approaching the base.

In some embodiments, the backrest mounting plate includes a first connecting plate segment, a second connecting plate segment and a third connecting plate segment; a first end of the first connecting plate segment, a first end of the second connecting plate segment and a first end of the third connecting plate segment are connected together; the second connecting plate segment and the third connecting plate segment are disposed on two opposite sides of the first connecting plate segment, respectively; a second end of the second connecting plate segment is hinged with the second front backrest connecting rod; a second end of the third connecting plate segment is hinged with the rear backrest connecting rod; and/or when the seat bracket is in the lying position, an included angle between an edge of the second connecting plate segment away from the first connecting plate segment and an edge of the second front backrest connecting rod close to the first connecting plate segment is α1, a value range of α1 being 80°≤α1≤88°.

In some embodiments, the seat bracket also includes an anti-forward-leaning mechanism, the anti-forward-leaning mechanism includes a reinforcing member, a second anti-forward-leaning rod and a first anti-forward-leaning rod, wherein two ends of the second anti-forward-leaning rod are hinged with the base and a first end of the first anti-forward-leaning rod, respectively; a middle of the first anti-forward-leaning rod is hinged with the linkage assembly; the reinforcing member is disposed at a second end of the first anti-forward-leaning rod; and when the seat bracket is in the lying position, the reinforcing member is configured to be abutted against the horizontal mounting base surface.

According to another aspect of the present disclosure, there is provided a zero-wall-gap seat, including the seat bracket provided above.

With the technical solutions of the present disclosure, the seat bracket includes the base, the linkage mechanism and the backrest mechanism. When the seat is switched from the TV position to the lying position, the linkage assembly and the bracket side plate are caused to move relative to the base; the linkage assembly is leaned forwards relative to the base; and the bracket side plate moves upwards and forwards relative to the base and rotates. An extent to which the linkage assembly is leaned forwards is greater than an extent to which the bracket side plate moves. The linkage assembly drives the lower end of the rear backrest connecting rod to move downwards. The backrest mounting plate moves downwards and rotates such that the backrest mounting plate is reclined. Moreover, when the backrest mounting plate moves downwards, relative rotation occurs between the first front backrest connecting rod and the second front backrest connecting rod such that the backrest mounting plate is closer to the bracket side plate. Moreover, the limiting plate and the backrest pivoting assembly form the four-connecting rod mechanism, or the limiting plate and the bracket side plate form the four-connecting rod mechanism, so that the motion range of the backrest mounting plate can be limited. Thus, the backrest mounting plate, when rotating and moving from the reset position to the reclined position, follows the linkage assembly to move forwards and downwards, and an extent of movement of the backrest mounting plate is greater than an extent of movement of the bracket side plate. The distance between the front end of the backrest mounting plate and the rear end of the bracket side plate decreases gradually such that the front end of the backrest mounting plate is closer to the seat frame of the bracket side plate, thus reducing the gap between the backrest part and the seat part, eliminating the risk of an item falling or pinching, and enhancing the use experience of a sofa.

BRIEF DESCRIPTION OF THE DRAWINGS

The drawings of the description constituting part of the present disclosure serve to provide a further understanding of the present disclosure. Exemplary embodiments of the present disclosure and description thereof are used to explain the present disclosure, and do not constitute improper limitation to the present disclosure. In the drawings.

Figure 1:
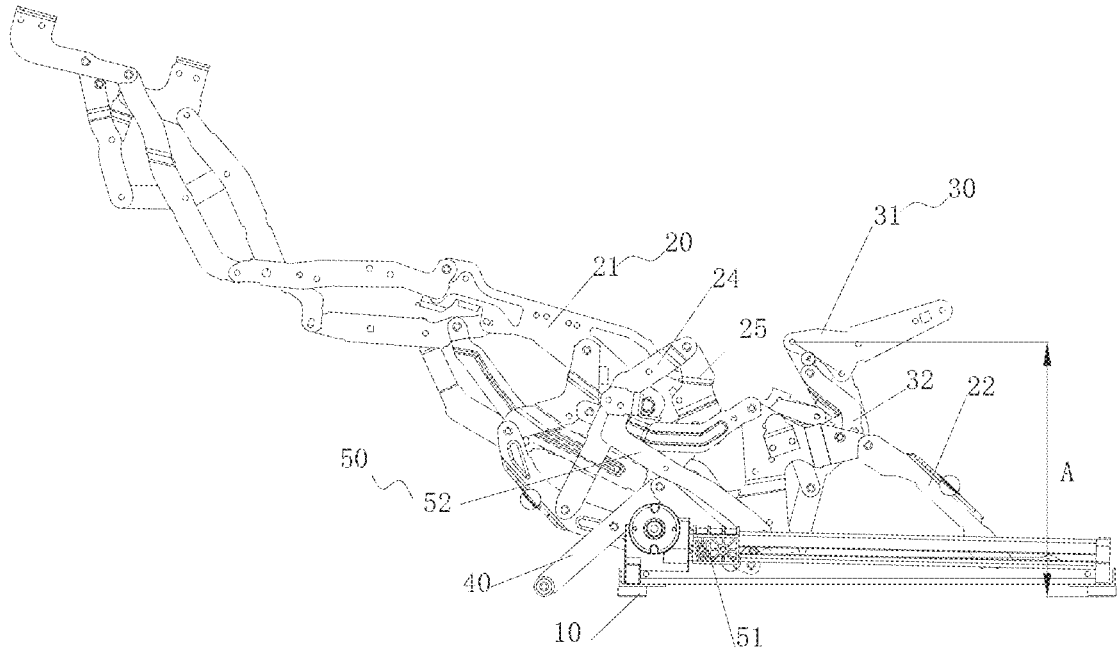
FIG. 1 illustrates a schematic structural diagram of a seat bracket in a lying position according to embodiments of the present disclosure.

The above drawings include the following reference numerals:

10, base;

20, linkage assembly; 21, bracket side plate; 22, linkage assembly; 221, first linkage plate; 222, second linkage plate; 223, third linkage plate; 224, fourth linkage plate; 225, fifth linkage plate; 24, first driving rod; 25, second driving rod; 26, third driving rod;

30, backrest mechanism; 31, backrest mounting plate; 311, sliding groove; 32, backrest pivoting assembly; 321, first front backrest connecting rod; 322, second front backrest connecting rod; 323, rear backrest connecting rod; 324, limit pin; 33, limiting plate; 331, first pivoting plate; 332, second pivoting plate; 232, backrest cushion;

40, anti-forward-leaning mechanism; 41, first anti-forward-leaning rod; 42, second anti-forward-leaning rod; 43, reinforcing member;

50, driving mechanism; 51, slider; 52, driving connecting rod; 53, driving rod; 54, front driving plate; 55, driving member; 56, guide rail; 57, transmission rod; 581, first connecting plate segment; 582, second connecting plate segment; 583, third connecting plate segment; 591, first connecting end; 592, second connecting end; 593, third connecting end;

60, footstool assembly; 601, footrest; 61, inner stool plate; 62, outer stool plate; 63, front stool plate; 64, rear stool plate; 65, first front stool connecting rod; 66, second front stool connecting rod; 67, rear stool connecting rod; 68, front footstool; 69, rear footstool;

71, first connecting rod; 72, second connecting rod; 73, third connecting rod; 74, fourth connecting rod; 75, support member;

A, distance between a front end of the backrest mounting plate and a lower surface of the base when the backrest mounting plate is in a reclined position;

B, included angle between the second front backrest connecting rod and a seat frame mounting surface of the bracket side plate when the backrest mounting plate is in the reclined position;

θ1, included angle between an upper surface of the footrest and a horizontal mounting base surface;

θ2, included angle between the backrest mounting plate and a preset axis of the bracket side plate;

β1, included angle between the backrest mounting plate and the horizontal mounting base surface;

β2, included angle between the preset axis of the bracket side plate and the horizontal mounting base surface;

d1, first preset distance;

d2, second preset distance;

d4, maximum distance between the rear footstool and the front footstool;

d5, height of a highest point of the rear footstool relative to the horizontal mounting base surface;

d6, height of a highest point of the front footstool relative to the horizontal mounting base surface;

d7, minimum distance between the highest point of the front footstool and the bracket side plate in the horizontal direction;

α1, included angle between an edge of the second connecting plate segment away from the first connecting plate segment and an edge of the second front backrest connecting rod close to the first connecting plate segment; and h1, distance between a highest point of the backrest cushion and the horizontal mounting base surface.

DETAILED DESCRIPTION OF THE EMBODIMENTS

The technical solutions in the embodiments of the present disclosure will be described clearly and completely below with reference to the accompanying drawings in the embodiments of the present disclosure. Apparently, the described embodiments are merely some rather than all of the embodiments of the present disclosure. The following description of at least one exemplary embodiment is merely illustrative, and not intended to limit the present disclosure or use thereof in any way. All the other embodiments obtained by those of ordinary skill in the art based on the embodiments in the present disclosure without creative effort fall within the scope of protection of the present disclosure.

As shown in FIG. 1 to FIG. 8, an embodiment of the present disclosure provides a seat bracket, the seat bracket includes a base 10, a linkage assembly 20 and a backrest mechanism 30. The linkage assembly 20 includes a bracket side plate 21 and a linkage assembly 22. The linkage assembly 22 is hinged with the base 10 and the bracket side plate 21 is hinged on the linkage assembly 22. The backrest mechanism 30 includes a backrest mounting plate 31, a backrest pivoting assembly 32 and a limiting plate 33. The backrest pivoting assembly 32 includes a first front backrest connecting rod 321, a second front backrest connecting rod 322 and a rear backrest connecting rod 323. A lower end of the first front backrest connecting rod 321 is hinged with the bracket side plate 21. An upper end of the first front backrest connecting rod 321 is hinged with a lower end of the second front backrest connecting rod 322. An upper end of the second front backrest connecting rod 322 is hinged with a front end of the backrest mounting plate 31. A lower end of the rear backrest connecting rod 323 is hinged with the linkage assembly 22. An upper end of the rear backrest connecting rod 323 is hinged with a rear end of the backrest mounting plate 31. The backrest mounting plate 31 has a reclined position tilted backwards relative to the base 10 and a reset position reset relative to the base 10. The limiting plate 33 is capable of forming a four-connecting rod mechanism with the backrest pivoting assembly 32 and/or the bracket side plate 21 to limit a motion range of the backrest mounting plate 31 between the reclined position and the reset position.

With the technical solutions of the present disclosure, the seat bracket includes the base 10, the linkage mechanism 20 and the backrest mechanism. When the seat is switched from a TV position to a lying position, the linkage assembly 22 and the bracket side plate 21 are caused to move relative to the base 10; the linkage assembly 22 is leaned forwards relative to the base 10; and the bracket side plate 21 moves upwards and forwards relative to the base 10 and rotates clockwise. An extent to which the linkage assembly 22 is leaned forwards is greater than an extent to which the bracket side plate 21 moves. The linkage assembly 22 drives the lower end of the rear backrest connecting rod 323 to move downwards. The backrest mounting plate 31 moves downwards and rotates clockwise such that the backrest mounting plate 31 is reclined. Moreover, when the backrest mounting plate 31 moves downwards, relative rotation occurs between the first front backrest connecting rod 321 and the second front backrest connecting rod 322 such that the backrest mounting plate 31 is closer to the bracket side plate 21. Moreover, the limiting plate 33 and the backrest pivoting assembly 32 form the four-connecting rod mechanism, or the limiting plate 33 and the bracket side plate 21 form the four-connecting rod mechanism, so that the motion range of the backrest mounting plate 31 can be limited. Thus, the backrest mounting plate 31, when rotating clockwise and moving from the reset position to the reclined position, follows the linkage assembly 22 to move forwards and downwards, and an extent of movement thereof is greater than an extent of movement of the bracket side plate 21. The distance between the front end of the backrest mounting plate 31 and the rear end of the bracket side plate 21 decreases gradually such that the front end of the backrest mounting plate 31 is closer to the seat frame of the bracket side plate 21, thus reducing the gap between the backrest part and the seat part, eliminating the risk of an item falling or pinching, and enhancing the use experience of a sofa.

In this embodiment, the limiting plate 33, the backrest pivoting assembly 32 and the backrest mounting plate 31 can form the four-connecting rod mechanism, or the limiting plate 33, the bracket side plate 21 and the backrest mounting plate 31 can form the four-connecting rod mechanism. The four-connecting rod mechanism can form a stable motion mechanism to play a role in guiding the backrest mounting plate 31 such that the structure is more compact and bears a greater horizontal force.

Figure 2:
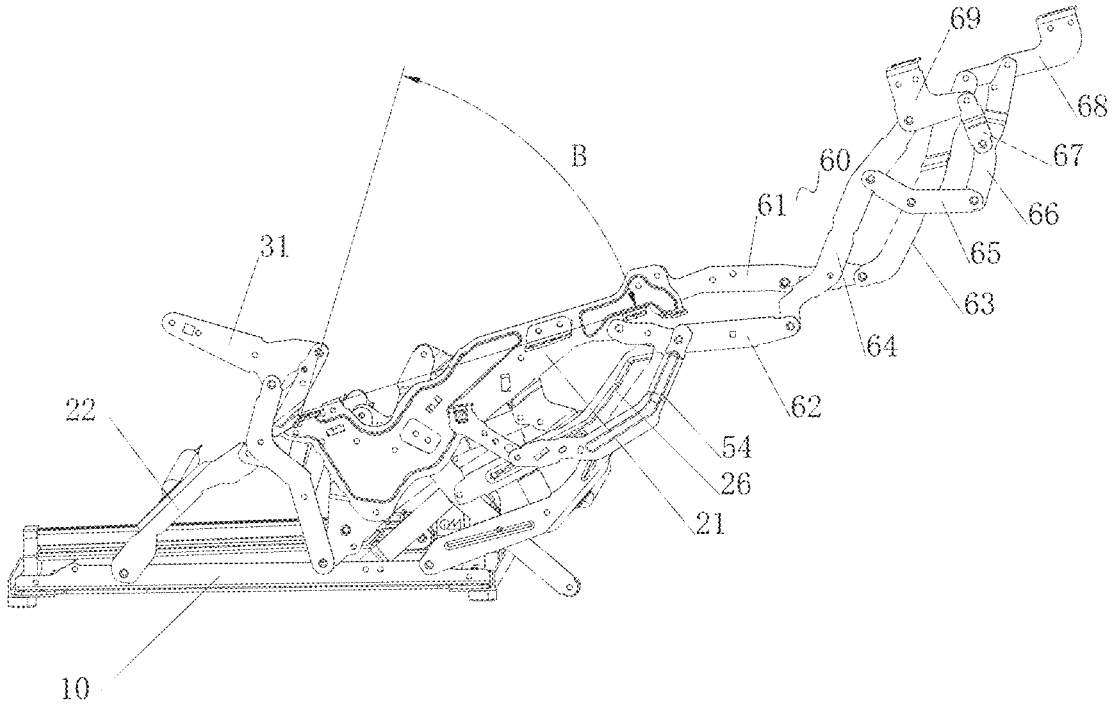
FIG. 2 illustrates another schematic structural diagram of a seat bracket in a lying position according to embodiments of the present disclosure.
Figure 3:
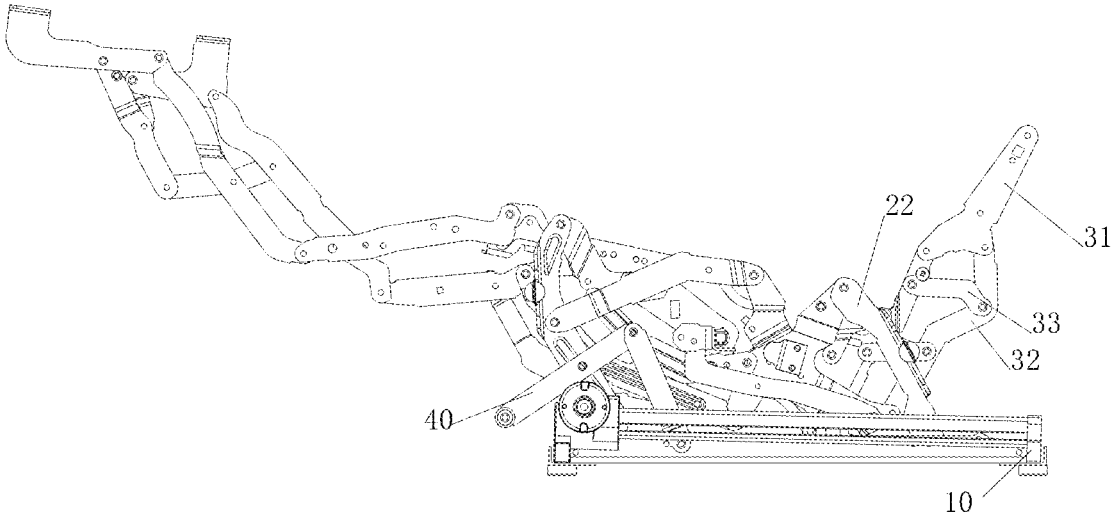
FIG. 3 illustrates a schematic structural diagram of a seat bracket in a TV position according to embodiments of the present disclosure.

It needs to be noted that rotation directions of the components of the seat bracket correspond to the viewpoint of the side view of the seat bracket in FIG. 2.

Figure 5:
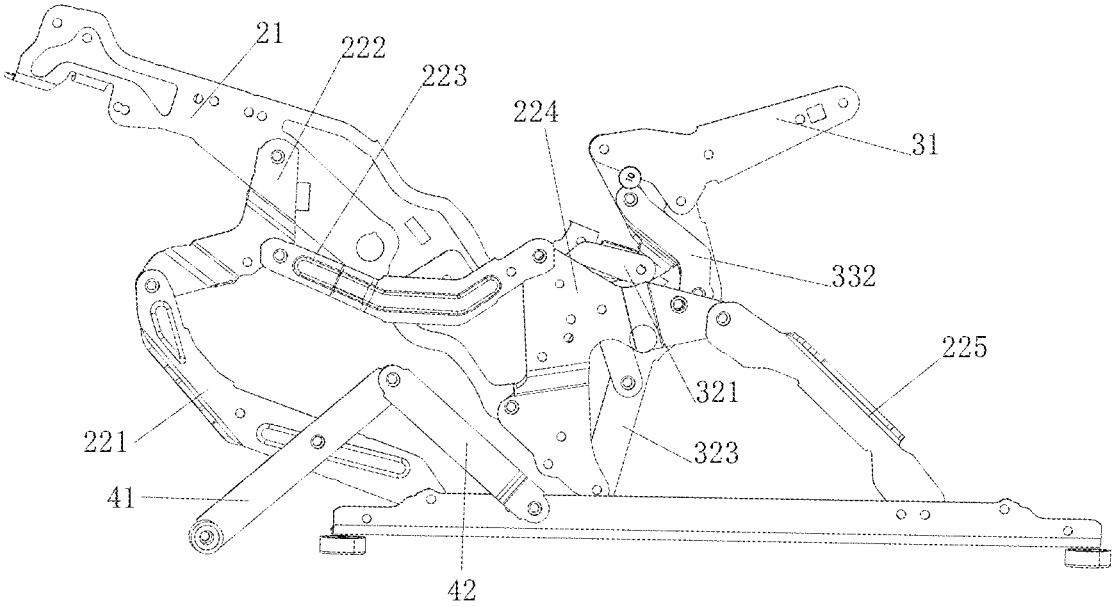
FIG. 5 illustrates a partial schematic diagram of a seat bracket in a lying position according to embodiments of the present disclosure.
Figure 6:
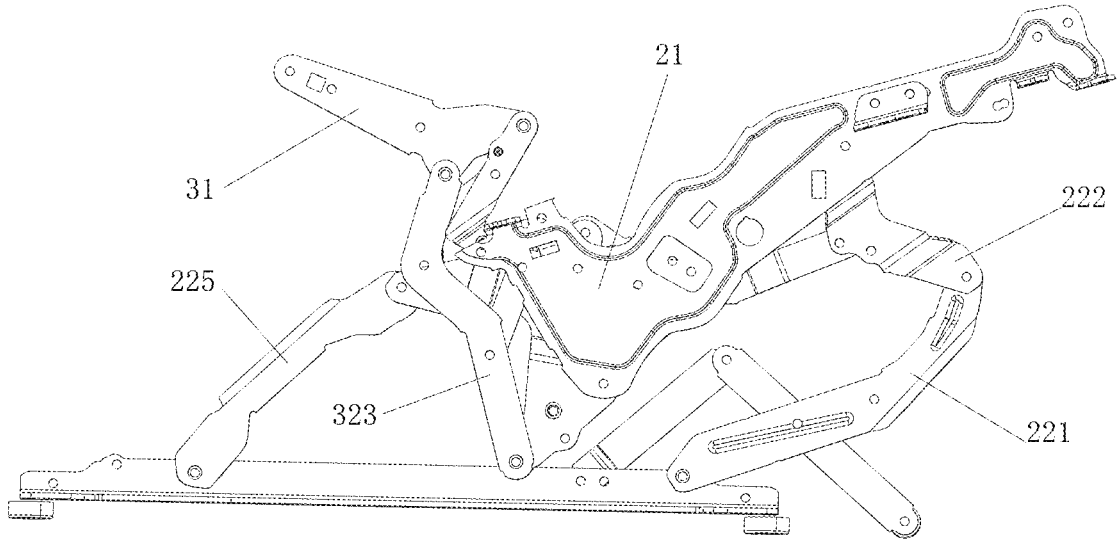
FIG. 6 illustrates another partial schematic diagram of a seat bracket in a lying position according to embodiments of the present disclosure.
Figure 7:
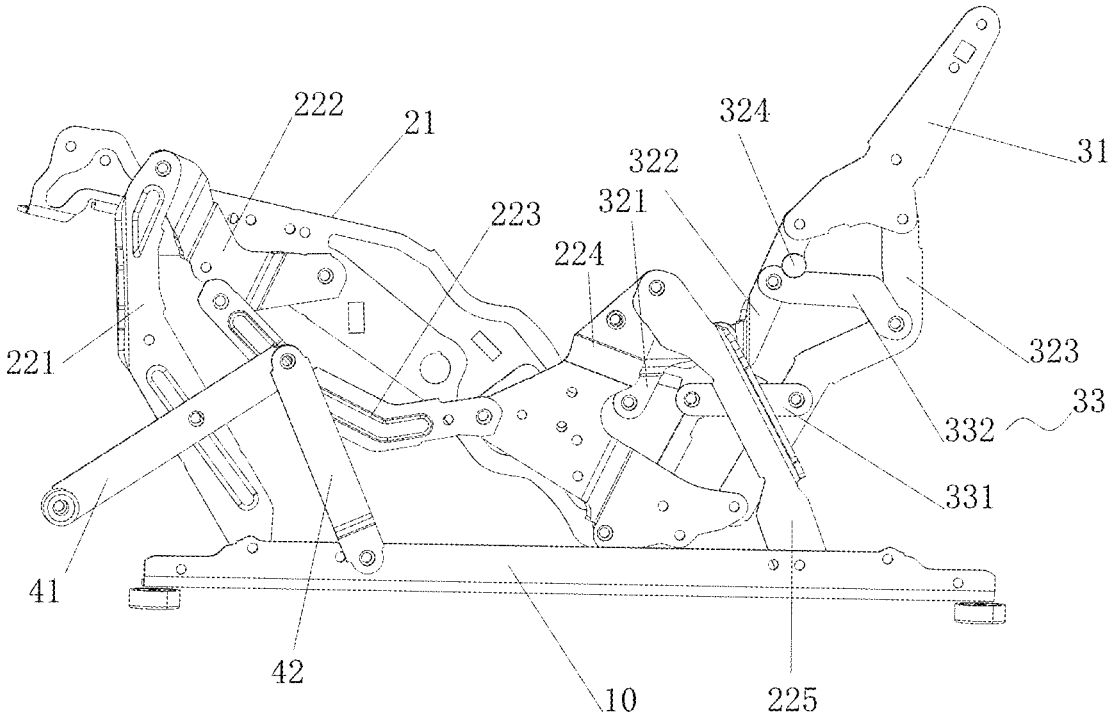
FIG. 7 illustrates a partial schematic diagram of a seat bracket in a TV position according to embodiments of the present disclosure.
Figure 8:
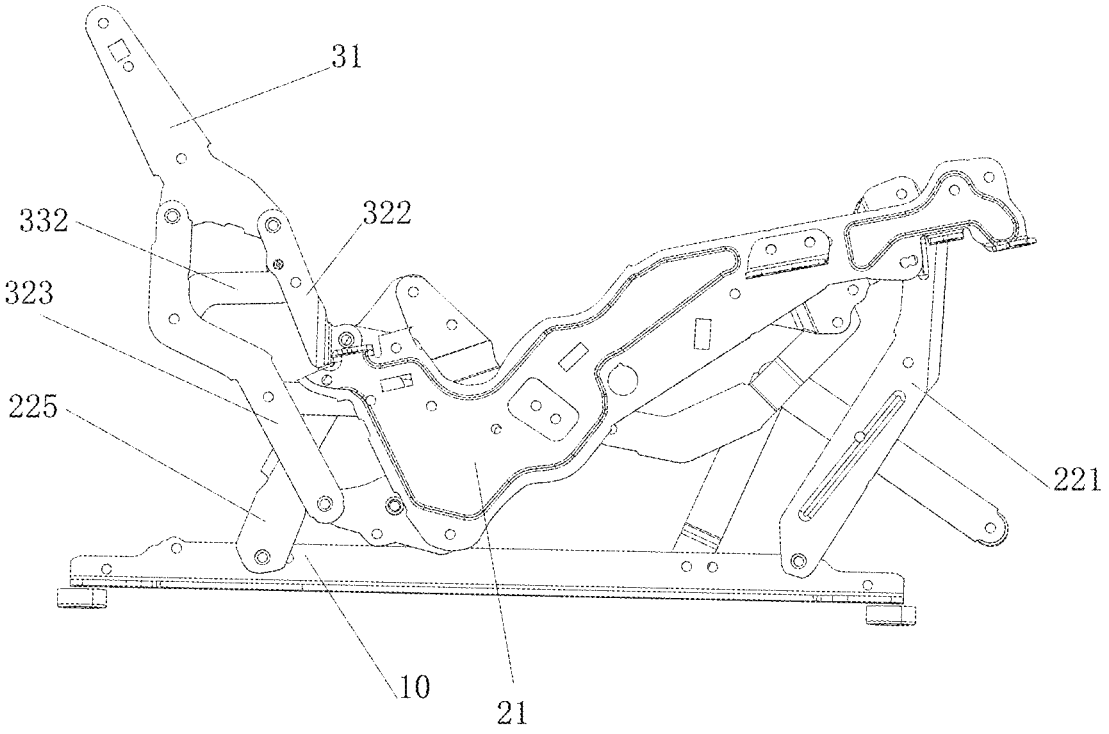
FIG. 8 illustrates another partial schematic diagram of a seat bracket in a TV position according to embodiments of the present disclosure.

As shown in FIG. 5 and FIG. 7, the limiting plate 33 includes a first pivoting plate 331. A front end of the first pivoting plate 331 is hinged with the bracket side plate 21, and a rear end of the first pivoting plate 331 is hinged with the rear backrest connecting rod 323. The first pivoting plate 331 can be utilized to form the four-connecting rod mechanism with the bracket side plate 21, the linkage assembly 22 and the rear backrest connecting rod 323 such that the motion of the seat bracket is more stable.

As shown in FIG. 5 and FIG. 7, the limiting plate 33 further includes a second pivoting plate 332. A front end of the second pivoting plate 332 is hinged with the second front backrest connecting rod, and a rear end of the second pivoting plate 332 is hinged with the rear backrest connecting rod 323; and a rear end of the first pivoting plate 331 is located below the rear end of the second pivoting plate 332. The second pivoting plate 332 can be utilized to form the four-connecting rod mechanism with the second front backrest connecting rod 322, the backrest mounting plate 31 and the rear backrest connecting rod 323 to limit the motion range of the backrest mounting plate 31 and make its motion more stable.

Specifically, when the rear backrest connecting rod 323 moves downwards, based on the structural characteristic of a linkage quadrilateral, the rear end of the first pivoting plate 331 can be driven to move downwards and drawn close to the bracket side plate 21. The first pivoting plate 331 can drive the upper end of the rear backrest connecting rod 323 to move downwards and draw it close to the bracket side plate 21 such that the four-connecting rod mechanism formed by the second front backrest connecting rod 322, the backrest mounting plate 31, the rear backrest connecting rod 323 and the second pivoting plate 332 is deformed, causing the second pivoting plate 332 to tilt under the limitation of the first front backrest connecting rod 321 and the second pivoting plate 332 while actuating the backrest mounting plate 31 to recline.

Moreover, in the process of the rear backrest connecting rod 323 moving downwards, the second pivoting plate 332 is driven to move downwards, and the second pivoting plate 332 drives the first front backrest connecting rod 321 and the second front backrest connecting rod 322 to rotate relatively, resulting in a folding action between them.

Figure 4:
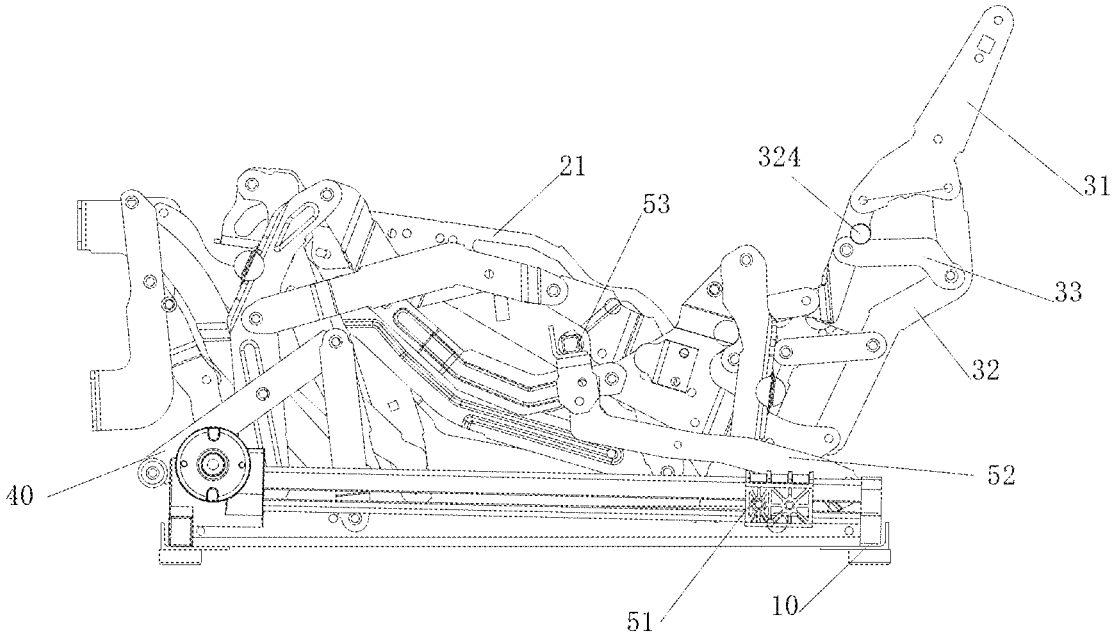
FIG. 4 illustrates a schematic structural diagram of a seat bracket in a sitting position, according to embodiments of the present disclosure.

As shown in FIG. 4, FIG. 5 and FIG. 7, the backrest pivoting assembly 32 further includes a limit pin 324 disposed on the second front backrest connecting rod 322. When the backrest mounting plate 31 is in the reclined position, the limit pin 324 is abutted against the backrest mounting plate 31. When the backrest mounting plate 31 is located in the reset position, the limit pin 324 is abutted against the second pivoting plate 332. In the sitting position and the TV position, the limit pin 324 is abutted against the second pivoting plate 332 so that the limit pin 324 can be limited from moving downwards, which in turn limits the second front backrest connecting rod 322 from moving downwards. Thus, it is realized that the supporting force of the backrest is better and more stable in the sitting position and the TV position. In the lying position, the limit pin 324 is abutted against the backrest mounting plate 31 such that the backrest mounting plate 31 is limited from moving downwards, realizing that the supporting force of the backrest is better and more stable in the lying position.

As shown in FIG. 5, the seat bracket further includes an anti-forward-leaning mechanism 40, the anti-forward-leaning mechanism 40 includes a first anti-forward-leaning rod 41 and a second anti-forward-leaning rod 42. An upper end of the first anti-forward-leaning rod 41 is hinged with an upper end of the second anti-forward-leaning rod 42. A middle of the first anti-forward-leaning rod 41 is hinged with a front end of the linkage assembly 22. A lower end of the second anti-forward-leaning rod 42 is hinged with the base 10. When the backrest mounting plate 31 is in the reclined position, a lower end of the first anti-forward-leaning rod 41 is in contact with the ground. With the above-mentioned anti-forward-leaning mechanism 40, in the lying position, the first anti-forward-leaning rod 41 is in contact with the ground to form support, thereby providing support for the seat bracket and reducing the forward leaning risk of the seat bracket in a zero gravity state.

In this embodiment, a rolling wheel is disposed at the lower end of the first anti-forward-leaning rod 41. In the lying position, the rolling wheel is in contact with the ground.

As shown in FIG. 2, when the backrest mounting plate 31 is in the reclined position, an included angle B between the second front backrest connecting rod 322 and a seat frame mounting surface of the bracket side plate 21 is between 40° and 70°. With the above-mentioned angle range, an acute angle is formed between the second front backrest connecting rod 322 and the seat frame mounting surface of the bracket side plate 21 such that the height of the front end of the backrest mounting plate 31 in the vertical direction is reduced, which in turn enables the height of the backrest to be lower, helping enhancing the zero gravity experience.

Specifically, compared with the existing zero-wall-gap seat, the backrest is moved downwards about 45 mm as a whole.

The included angle B between the second front backrest connecting rod 322 and the seat frame mounting surface of the bracket side plate 21 may be 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, or any value between 40° and 70°.

It needs to be noted that when the included angle B between the second front backrest connecting rod 322 and the seat frame mounting surface of the bracket side plate 21 is between 54° and 58°, the height of the backrest can be lower, and the zero gravity experience of the seat is better.

In this embodiment, an L-shaped support plate is disposed on a side portion of the bracket side plate 21 to form the seat frame mounting surface.

A connecting line of centers of hinged points of two ends of the second front backrest connecting rod 322 is one side of the angle B, and the other side of the angle is a projection of the seat frame mounting surface of the bracket side plate 21 in the side view shown in FIG. 2.

As shown in FIG. 1, when the backrest mounting plate 31 is in the reclined position, a distance A between the front end of the backrest mounting plate 31 and a lower surface of the base 10 is between 260 mm and 300 mm. With the above-mentioned size range, the height of the backrest mounting plate 31 can be lower, helping enhancing the zero gravity experience.

The distance A between the front end of the backrest mounting plate 31 and the lower surface of the base 10 may be 260 mm, 270 mm, 280 mm, 290 mm, 300 mm, or any value between 260 mm and 300 mm.

It needs to be noted that when the distance A between the front end of the backrest mounting plate 31 and the lower surface of the base 10 is between 270 mm and 290 mm, the height of the backrest can be lower, and the zero gravity experience of the seat is better.

As shown in FIG. 7, the linkage assembly 22 includes a first linkage plate 221, a second linkage plate 222, a third linkage plate 223, a fourth linkage plate 224 and a fifth linkage plate 225. A lower end of the first linkage plate 221 is hinged with the base 10. An upper end of the first linkage plate 221 is hinged with a front end of the second linkage plate 222. A rear end of the second linkage plate 222 is hinged with the bracket side plate 21. A front end of the third linkage plate 223 is hinged with a middle of the second linkage plate 222. A rear end of the third linkage plate 223 is hinged with a front end of the fourth linkage plate 224. A lower end of the fourth linkage plate 224 is hinged with a lower end of the bracket side plate 21. A rear end of the fourth linkage plate 224 is hinged with the rear backrest connecting rod 323. An upper end of the fourth linkage plate 224 is hinged with an upper end of the fifth linkage plate 225. A lower end of the fifth linkage plate 225 is hinged with the base 10. With the above-mentioned linkage assembly 22, when the seat is switched from the TV position to the lying position, the backrest mounting plate 31 is moved from the reset position to the reclined position. The first linkage plate 221 and the fifth linkage plate 225 are leaned forwards relative to the base 10, and the upper end of the first linkage plate 221 moves forwards and downwards and drives the second linkage plate 222 to rotate anticlockwise relative to the bracket side plate 21. The front end of the second linkage plate 222 moves downwards, and the second linkage plate 222 drives the third linkage plate 223 to rotate anticlockwise. The front end of the third linkage plate 223 moves downwards, and the rear end thereof moves upwards, and the third linkage plate 223 drives the fourth linkage plate 224 to rotate clockwise relative to the bracket side plate 21. The fourth linkage plate 224 drives the fifth linkage plate 225 to lean forwards relative to the base 10 and drives the lower end of the rear backrest connecting rod 323 to move downwards.

The middle of the first anti-forward-leaning rod 41 is hinged with the first linkage plate 221.

As shown in FIG. 1 and FIG. 4, the seat bracket further includes a driving mechanism 50, the driving mechanism 50 includes a driving member 55, a slider 51, a driving connecting rod 52 and a driving rod 53. The driving member 55 is in driving connection with the slider 51 to drive the slider 51 to move along a front-rear direction of the base 10. The driving connecting rod 52 extends along the front-rear direction of the base 10. The driving rod 53 extends along a left-and-right direction of the base 10. The slider 51 is hinged with a lower end of the driving connecting rod 52. An upper end of the driving connecting rod 52 is hinged with the driving rod 53. The driving rod 53 is in driving connection with the bracket side plate 21. In a process of the driving member 55 driving the slider 51 to slide, the slider 51 is capable of driving the driving connecting rod 52 to rotate, thereby moving the driving rod 53 forwards and upwards. The driving rod 53 drives, by the bracket side plate 21 and the linkage assembly 22, the backrest mounting plate 31 to move from the reset position to the reclined position. The driving member 55 drives the slider 51 to slide forwards along the front-rear direction of the base 10. The rear end of the driving connecting rod 52 rotates relative to the slider 51, while the front end of the driving connecting rod 52 moves forwards and upwards relative to the slider 51 and drives the driving rod 53 to move forwards and upwards, and the driving rod 53 in turn drives the bracket side plate 21 in driving connection therewith to move forwards and upwards. The bracket side plate 21 drives the linkage assembly 22 to move forwards and upwards relative to the base 10.

Specifically, the bracket side plate 21 has a through hole penetrating therethrough, and the driving rod 53 is disposed as passing through the through hole.

As shown in FIG. 2, the seat bracket further includes a footstool assembly 60, the footstool assembly 60 includes an inner stool plate 61, an outer stool plate 62, a front stool plate 63, a rear stool plate 64, a first front stool connecting rod 65, a second front stool connecting rod 66, a rear stool connecting rod 67, a front footstool 68 and a rear footstool 69. A rear end of the outer stool plate 62 is hinged with the bracket side plate 21. A front end of the outer stool plate 62 is hinged with a rear end of the rear stool plate 64. A rear end of the inner stool plate 61 is hinged with the bracket side plate 21. A front end of the inner stool plate 61 is hinged with a rear end of the front stool plate 63. A middle of the inner stool plate 61 is hinged with a middle of the rear stool plate 64. A rear end of the first front stool connecting rod 65 is hinged with the middle of the rear stool plate 64. A middle of the first front stool connecting rod 65 is hinged with a middle of the front stool plate 63. A front end of the first front stool connecting rod 65 is hinged with a rear end of the second front stool connecting rod 66. The front footstool 68 is connected with a front end of the front stool plate 63 and a front end of the second front stool connecting rod 66, respectively. A lower end of the rear stool connecting rod 67 is hinged with a middle of the second front stool connecting rod 66. The rear footstool 69 is separately hinged with a front end of the rear stool plate 64 and an upper end of the rear stool connecting rod 67.

In this embodiment, the left and right sides of the seat bracket are of a symmetrical structure, and the linkage mechanisms 20 and the backrest mechanisms 30 are disposed on both sides of the seat bracket. Meanwhile, to make the seat bracket steadier, a connecting cross beam extending along the horizontal direction is disposed between the linkage mechanisms 20 on both sides of the seat bracket.

The driving member 55 is a linear motor.

In this embodiment, in an electric powering solution, the driving mechanism 50 further includes a front driving plate 54. Two ends of the front driving plate 54 are hinged with the driving rod 53 and the outer stool plate 62, respectively. In a non-electric powering solution, the linkage mechanism 20 further includes a first driving rod 24, a second driving rod 25 and a third driving rod 26. A front end of the first driving rod 24 is hinged with a middle of the first linkage plate 221. A rear end of the first driving rod 24 is hinged with an upper end of the second driving rod 25. A middle of the second driving rod 25 is hinged with the bracket side plate 21. A lower end of the second driving rod 25 is hinged with a rear end of the third driving rod 26. A front end of the third driving rod 26 is hinged with the outer stool plate 62.

In the process of the driving member 55 driving the slider 51 to slide, the slider 51 is capable of driving the driving connecting rod 52 to rotate, which in turn drives the driving rod 53 to rotate. The driving rod 53 drives the front driving plate 54 to move forwards. The front driving plate 54 drives the outer stool plate 62 to protrude relative to the bracket side plate 21. The outer stool plate 62 drives the rear stool plate 64 to protrude, and the rear stool plate 64 drives the inner stool plate 61 to protrude, and the inner stool plate 61 drives the front stool plate 63 to protrude. A four-connecting rod structure formed by the front stool plate 63, the front footstool 68, the first front stool connecting rod 65 and the second front stool connecting rod 66 drives the front footstool 68 to protrude, and the rear stool plate 64 and the rear stool connecting rod 67 jointly drive the rear footstool 69 to protrude such that the footstool assembly 60 is switched to a collapsed position to a stretched position. The retracting process of the footstool assembly 60 is opposite to the above-mentioned process, which will not be described redundantly here.

In the non-electric powering solution, in the process of stretching the footstool assembly 60, the bracket side plate 21 moves forwards relative to the linkage assembly 22 such that the rear end of the first driving rod 24 moves backwards, which in turn drives the second driving rod 25 to rotate relative to the bracket side plate 21. The upper end of the second driving rod 25 moves backwards, while the front end thereof moves forwards, and the second driving rod 25 drives the third driving rod 26 to move forwards, thereby urging the footstool assembly 60 to stretch.

The lying position of the seat bracket corresponds to the footstool assembly being in the stretched position and the backrest mounting plate 31 being in the reclined position; the TV position of the seat bracket corresponds to the footstool assembly being in the stretched position and the backrest mounting plate 31 being in the reset position; and the sitting position of the seat bracket corresponds to the footstool assembly being in the collapsed position and the backrest mounting plate 31 being in the reset position.

With reference to FIG. 9 to FIG. 14, another embodiment of the present disclosure provides a zero-wall-gap seat, including the seat bracket provided above. The backrest mounting plate 31, when rotating clockwise and moving from the reset position to the reclined position, follows the linkage assembly 22 to move forwards and downwards, and an extent of movement thereof is greater than an extent of movement of the bracket side plate 21. The distance between the front end of the backrest mounting plate 31 and the rear end of the bracket side plate 21 decreases gradually such that the front end of the backrest mounting plate 31 is closer to the seat frame of the bracket side plate 21, thus reducing the gap between the backrest part and the seat part, eliminating the risk of an item falling or pinching, and enhancing the use experience of a sofa.

The backrest mounting plate 31 is configured for mounting of the backrest of the seat. Since relative rotation occurs between the first front backrest connecting rod 321 and the second front backrest connecting rod 322 when the backrest mounting plate 31 moves downwards, the front end of the backrest can move a greater distance forwards when the backrest is laid down, such that the backrest of the seat does not interfere with the wall in the process of being laid down, thereby realizing the zero-wall-gap function.

The seat bracket provided in the present disclosure includes two linkage mechanisms 20, wherein the base 10 is disposed on a horizontal mounting base surface, and the two linkage mechanisms 20 are disposed on two opposite sides of the base 10, respectively. The bracket side plate 21 is configured to be connected with the seat frame of the zero-wall-gap seat. The bracket side plate 21 is movably disposed on the base 10. The seat bracket further includes a footstool assembly 60. The footstool assembly 60 and the backrest mechanism 30 are both movably connected with the bracket side plate 21. The footstool assembly 60 includes a footrest 601. The backrest mechanism 30 includes a backrest mounting plate 31 that is configured to be connected with a backrest cushion 232 of the zero-wall-gap seat. The seat bracket has a sitting position, a TV position and a lying position. The bracket side plates 21 of each of the two linkage mechanisms 20 is disposed movably such that the seat bracket can be reciprocally switched between the sitting position, the TV position and the lying position, wherein when the seat bracket is in the sitting position, the footrest 601 is retracted below the seat frame, and a minimum distance between a highest point of the backrest cushion 232 and a preset vertical plane is equal to zero; when the seat bracket is in the TV position, the footrest 601 is stretched in front of the seat frame and tilted relative to a horizontal direction, and a distance between the highest point of the backrest cushion 232 and the preset vertical plane is greater than zero; when the seat bracket is in the lying position, compared with the seat bracket being in the TV position, the backrest cushion is reclined, and the highest point of the backrest cushion 232 is lowered down, and the minimum distance between the highest point of the backrest cushion 232 and the preset vertical plane is equal to zero; and a height of a highest point of the footstool assembly 60 relative to the horizontal mounting base surface is greater than a height of a highest point of the backrest mechanism 30 relative to the horizontal mounting base surface.

When the seat bracket of the present disclosure is in the sitting position, the footrest 601 is retracted below the seat frame, and the highest point of the backrest cushion 232 is in contact with the preset vertical plane. When the seat bracket is in the TV position, compared with the seat bracket being in the sitting position, the distances of the footrest 601 with the seat frame in the horizontal direction and the vertical direction increase such that the footrest 601 is stretched in front of the seat frame and tilted relative to the horizontal direction, and the distance between the highest point of the backrest cushion 232 and the preset vertical plane is greater than zero. When the seat bracket is in the lying position, compared with the seat bracket being in the TV position, the minimum distance between the highest point of the backrest cushion 232 and the preset vertical plane is equal to zero, and the height of the highest point of the footstool assembly 60 relative to the horizontal mounting base surface is greater than the height of the highest point of the backrest mechanism 30 relative to the horizontal mounting base surface. Therefore, the legs of a user can be roughly flush with the heart or slightly higher than the heart, achieving the technical effect of zero gravity. Moreover, since the minimum distance between the highest point of the backrest cushion 232 and the preset vertical plane is equal to zero when the seat bracket is in the sitting position and the lying position, the user does not need to reserve a mounting clearance when mounting the zero-wall-gap seat. Moreover, since the backrest cushion 232 does not interfere with the preset vertical plane when the seat bracket is switched between the sitting position, the TV position and the lying position, zero-wall-gap arrangement of the zero-wall-gap seat can be realized. Thus, the problem that an iron stand landing zero-wall-gap seat in the prior art cannot meet the requirements of customers on the zero-wall-gap arrangement and the zero-gravity comfort experience of the zero-wall-gap seat is solved, and the zero-wall-gap seat may have the advantages of both zero wall gap and zero gravity, more convenient placement, and more comfort in use.

Specifically, the preset vertical plane may be a vertical wall surface, and the horizontal mounting base surface may be a horizontal floor. The footrest 601 is configured to be connected with a footrest cushion of the zero-wall-gap seat, and the feet and legs of the user may be put on the footrest cushion.

Figure 12:
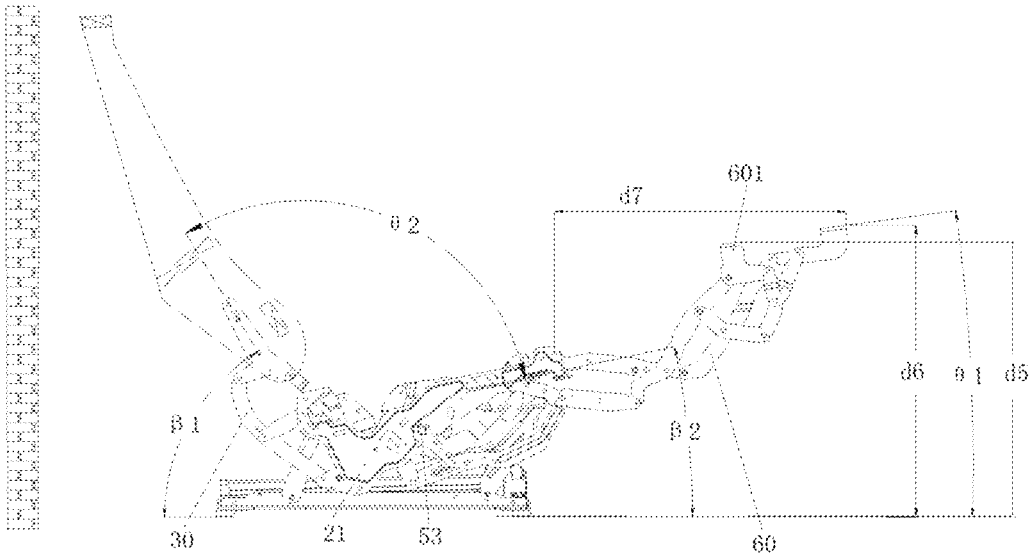
FIG. 12 illustrates a schematic structural diagram of a seat bracket (without an anti-forward-leaning mechanism) in a TV position and a preset vertical plane according to embodiments of the present disclosure.
Figure 13:
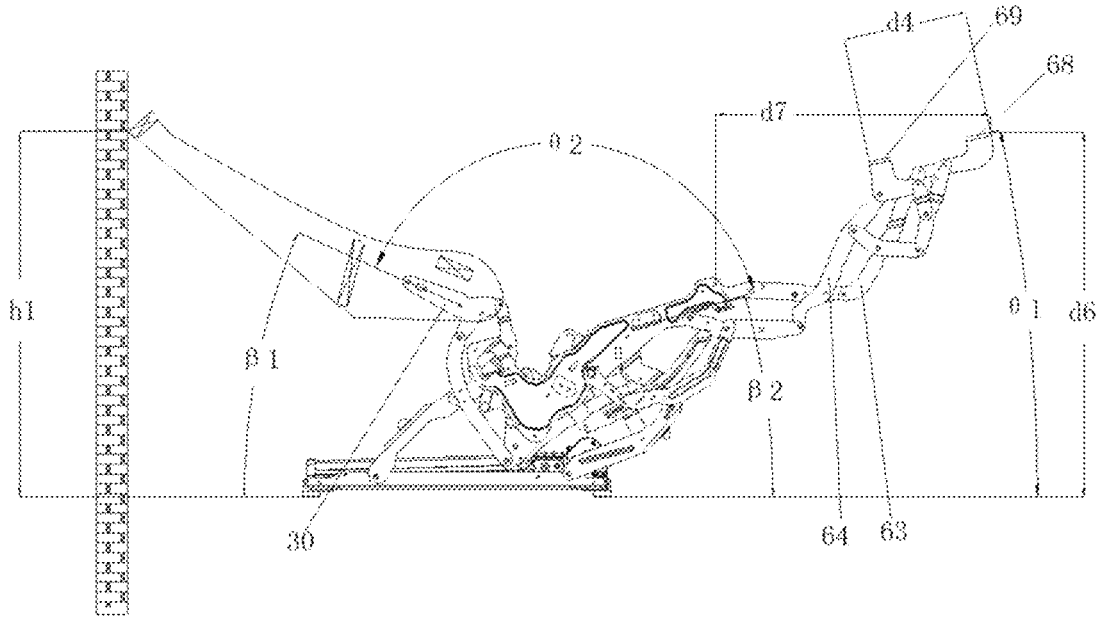
FIG. 13 illustrates a schematic structural diagram of a seat bracket (without an anti-forward-leaning mechanism) in a lying position and a preset vertical plane according to embodiments of the present disclosure.

In this embodiment, as shown in FIG. 12 and FIG. 13, when the seat bracket is in the lying position, a value range of an included angle θ1 between an upper surface of the footrest 601 and the horizontal mounting base surface is $7° \leq \theta 1 \leq 13°$, θ1 may be 7°, 9°, 10°, 11°, 12°, 13°; and when the seat bracket is in the TV position, the value range of the included angle θ1 between the upper surface of the footrest 601 and the horizontal mounting base surface is $3° \leq \theta 1 \leq 9°$, θ1 may be 3°, 5°, 6°, 7°, 9°.

In this embodiment, as shown in FIG. 12 and FIG. 13, two footrests 601 are provided, one of two footrests 601 is a rear footstool 69 and the other one of two footrests 601 is a front footstool 68. A highest point of the front footstool 68 is higher than a highest point of the rear footstool 69, and a height of the highest point of the rear footstool 69 relative to the horizontal mounting base surface is greater than a height of a highest point of the backrest mounting plate 31 relative to the horizontal mounting base surface. The value range of the included angle θ1 between the upper surface of the front footstool 68 and the horizontal mounting base surface is $7° \leq \theta 1 \leq 12°$, θ1 may be 7°, 9°, 10°, 11°, 12°; and when the seat bracket is in the TV position, the value range of the included angle θ1 between the upper surface of the front footstool 68 and the horizontal mounting base surface is $3° \leq \theta 1 \leq 7°$, θ1 may be 3°, 5°, 6°, 7°.

Specifically, the height of the highest point of the rear footstool 69 relative to the horizontal mounting base surface is greater than the height of the highest point of the backrest mounting plate 31 relative to the horizontal mounting base surface. In this way, it is guaranteed that the legs of the user can be roughly flush with the heart or slightly higher than the heart, achieving the technical effect of zero gravity.

Preferably, when the seat bracket is in the lying position, the included angle θ1 between the upper surface of the front footstool 68 and the horizontal mounting base surface is 9°; and when the seat bracket is in the TV position, the included angle θ1 between the upper surface of the front footstool 68 and the horizontal mounting base surface is 5°. In this way, the angle of the front footstool 68 is gentler such that the positions of the lower legs or feet of the user are gentler in use. The use comfort of the user may be improved.

Figure 11:
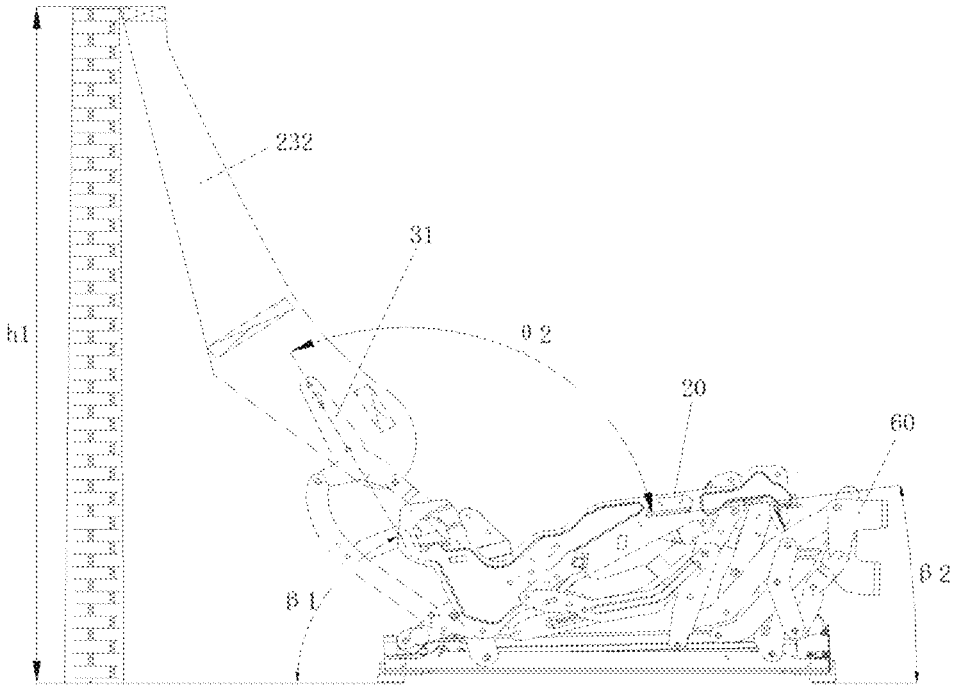
FIG. 11 illustrates a schematic structural diagram of a seat bracket (without an anti-forward-leaning mechanism) in a sitting position and a preset vertical plane according to embodiments of the present disclosure.

In this embodiment, as shown in FIG. 11 to FIG. 13, when the seat bracket is in the lying position, a value range of an included angle β1 between the backrest mounting plate 31 and the horizontal mounting base surface is $15° \leq \beta 1 \leq 30°$, β1 may be 15°, 20°, 25°, 30°. When the seat bracket is in the sitting position, the value range of the included angle β1 between the backrest mounting plate 31 and the horizontal mounting base surface is 55°≤β1≤65°, β1 may be 55°, 60°, 65°. When the seat bracket is in the TV position, the value range of the included angle β1 between the backrest mounting plate 31 and the horizontal mounting base surface is 55°≤β1≤65°, β1 may be 55°, 57°, 58°, 59°, 60°, 61°, 63°, 65°. In a process of the seat bracket being switched from the sitting position to the lying position, a value range of an angle variation δ1 of the included angle β1 between the backrest mounting plate 31 and the horizontal mounting base surface is 25°≤δ1≤50°, δ1 may be 25°, 35°, 45°, 50°, wherein $\delta 1=\beta 1_{sitting\ position}-\beta 1_{lying\ position}$.

Preferably, when the seat bracket is in the lying position, the included angle β1 between the backrest mounting plate 31 and the horizontal mounting base surface is equal to 24°. When the seat bracket is in the sitting position, the included angle β1 between the backrest mounting plate 31 and the horizontal mounting base surface is equal to 62°. When the seat bracket is in the TV position, the included angle β1 between the backrest mounting plate 31 and the horizontal mounting base surface is equal to 59°.

Specifically, this may guarantee that an extent to which the backrest mounting plate 31 is laid down is moderate, which is fit with the body structure of the user, thus improving the use comfort of the user.

In this embodiment, as shown in FIG. 11 to FIG. 13, when the seat bracket is in the lying position, a value range of an included angle β2 of a preset axis of the bracket side plate 21 and the horizontal mounting base surface is 13°≤β2≤19°, β2 may be 13°, 15°, 17°, 19°. When the seat bracket is in the sitting position, the value range of the included angle β2 of the preset axis of the bracket side plate 21 and the horizontal mounting base surface is 6°≤β2≤12°, β2 may be 6°, 7°, 8°, 9°, 10°, 11°, 12°. When the seat bracket is in the TV position, the value range of the included angle β2 of the preset axis of the bracket side plate 21 and the horizontal mounting base surface is 10°≤β2≤15°, β2 may be 10°, 11°, 12°, 13°, 14°, 15°. In a process of the seat bracket being switched from the sitting position to the lying position, a value range of an angle variation δ2 of the included angle β2 of the preset axis of the bracket side plate 21 and the horizontal mounting base surface is 3°≤δ2≤13°, δ2 may be 3°, 5°, 7°, 9°, 11°, 13°.

Preferably, when the seat bracket is in the lying position, the included angle β2 of the preset axis of the bracket side plate 21 and the horizontal mounting base surface is equal to 16°. When the seat bracket is in the sitting position, the included angle β2 of the preset axis of the bracket side plate 21 and the horizontal mounting base surface is equal to 8°. When the seat bracket is in the TV position, the included angle β2 of the preset axis of the bracket side plate 21 and the horizontal mounting base surface is equal to 13°.

Specifically, this makes the angle of the seat frame gentler and avoids that an extent to which the body of the user is risen up is too large, thus improving the use comfort of the user.

In this embodiment, as shown in FIG. 13, the footstool assembly 60 includes a rear stool plate 64 and a front stool plate 63. One end of the rear stool plate 64 and one end of the front stool plate 63 are both hinged with the bracket side plate 21. The other end of the rear stool plate 64 is hinged with the rear footstool 69. The other end of the front stool plate 63 is hinged with the front footstool 68. When the seat bracket is in the lying position and the TV position respectively, a value range of a maximum distance d4 between the rear footstool 69 and the front footstool 68 is 210 mm≤d4≤270 mm, d4 may be 210 mm, 230 mm, 250 mm, 270 mm, and a height d6 of the highest point of the front footstool 68 relative to the horizontal mounting base surface is 623 mm and 505 mm, respectively. When the seat bracket is in the lying position, a value range of a height d5 of the highest point of the rear footstool 69 relative to the horizontal mounting base surface is 560 mm≤d5≤600 mm, d5 may be 560 mm, 570 mm, 580 mm, 590 mm, 600 mm. When the seat bracket is in the TV position, the value range of the height d5 of the highest point of the rear footstool 69 relative to the horizontal mounting base surface is 450 mm≤d5≤500 mm, d5 may be 450 mm, 470 mm, 490 mm, 500 mm.

Specifically, the footrest cushion is sleeved on the two footrests 601, and the value range of the maximum distance d4 between the rear footstool 69 and the front footstool 68 is set to 210 mm≤d4≤270 mm such that the distance between the unfolded rear footstool 69 and front footstool 68 is greater than the distance between the folded rear footstool 69 and front footstool 68. As such, the overall area of the footrest cushion can be increased, meeting the use demand of a user with long legs.

Optionally, when the seat bracket is in the lying position, the height d5 of the highest point of the rear footstool 69 relative to the horizontal mounting base surface is 580 mm, and the height d6 of the highest point of the front footstool 68 relative to the horizontal mounting base surface is 623 mm. When the seat bracket is in the TV position, the height d5 of the highest point of the rear footstool 69 relative to the horizontal mounting base surface is 478 mm, and the height d6 of the highest point of the front footstool 68 relative to the horizontal mounting base surface is 505 mm.

Figure 14:
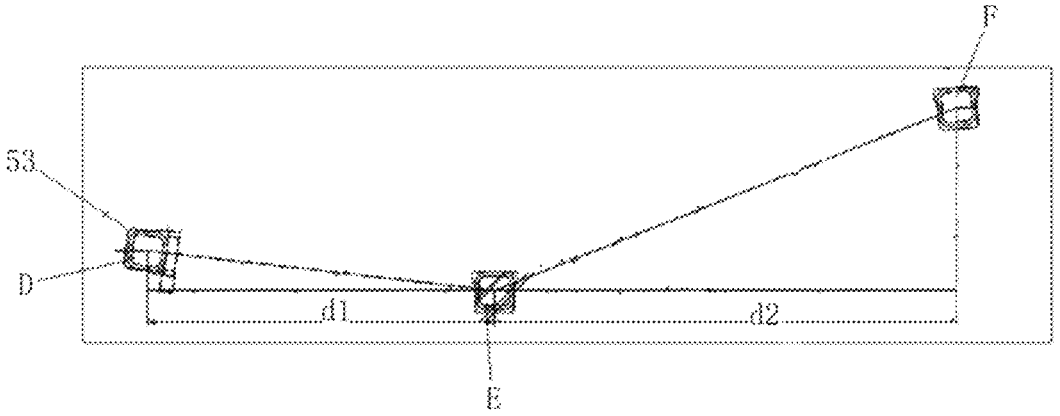
FIG. 14 illustrates a schematic diagram of a moving distance of a driving rod when a seat bracket is switched between a sitting position, a TV position and a lying position according to embodiments of the present disclosure.

In this embodiment, as shown in FIG. 14, the seat bracket further includes a driving member 55 and a driving rod 53. The driving rod 53 is movably penetrated through the bracket side plate 21. The driving rod 53 is in transmission connection with the footrest 601. The driving member 55 is in driving connection with the driving rod 53 to drive the driving rod 53 to move such that the driving rod 53 drives the bracket side plate 21 to move, causing the seat bracket to reciprocally switch between the sitting position, the TV position and the lying position. Before the bracket side plate 21 moves a first preset distance d1 forwards, the driving rod 53 is disposed rotatably about an axis of the driving rod 53 and disposed movably along the horizontal direction such that the driving rod 53 drives the footrest 601 to move, causing the seat bracket to switch from the sitting position to the TV position. Before the bracket side plate 21 continues to move a second preset distance d2 forwards, the driving rod 53 is disposed movably along the horizontal direction to drive the bracket side plate 21 and the backrest mounting plate 31 to move, causing the seat bracket to switch from the TV position to the lying position.

Specifically, the driving member 55 is configured to drive the driving rod 53 to move, and the driving rod 53 is configured to drive the footrest 601 and the bracket side plate 21 to move, causing the seat bracket to smoothly switch between the sitting position, the TV position and the lying position. The driving member 55 drives the driving rod 53 to rotate around the axis thereof and move along the horizontal direction such that the driving rod 53 drives the footrest 601 to move, and meanwhile, the driving rod 53 drives the bracket side plate 21 to move the first preset distance d1 forwards. At this point, the seat bracket is switched from the sitting position to the TV position and then the driving rod 53 cannot rotate, and the driving rod 53 can only drive the bracket side plate 21 to continue to move the second preset distance d2 forwards in the horizontal direction. At this point, the seat bracket is switched from the TV position to the lying position.

Specifically, a cross section of the driving rod 53 along an axial direction of the driving rod 53 is rectangular or polygonal. As shown in FIG. 14, area D in the figure shows the position of the driving rod 53 when the seat bracket is in the sitting position; area E in the figure shows the position of the driving rod 53 when the seat bracket is in the TV position; and area F in the figure shows the position of the driving rod 53 when the seat bracket is in the lying position. The first preset distance d1 is 117.04 mm, and the second preset distance d2 is 155.82 mm.

Figure 9:
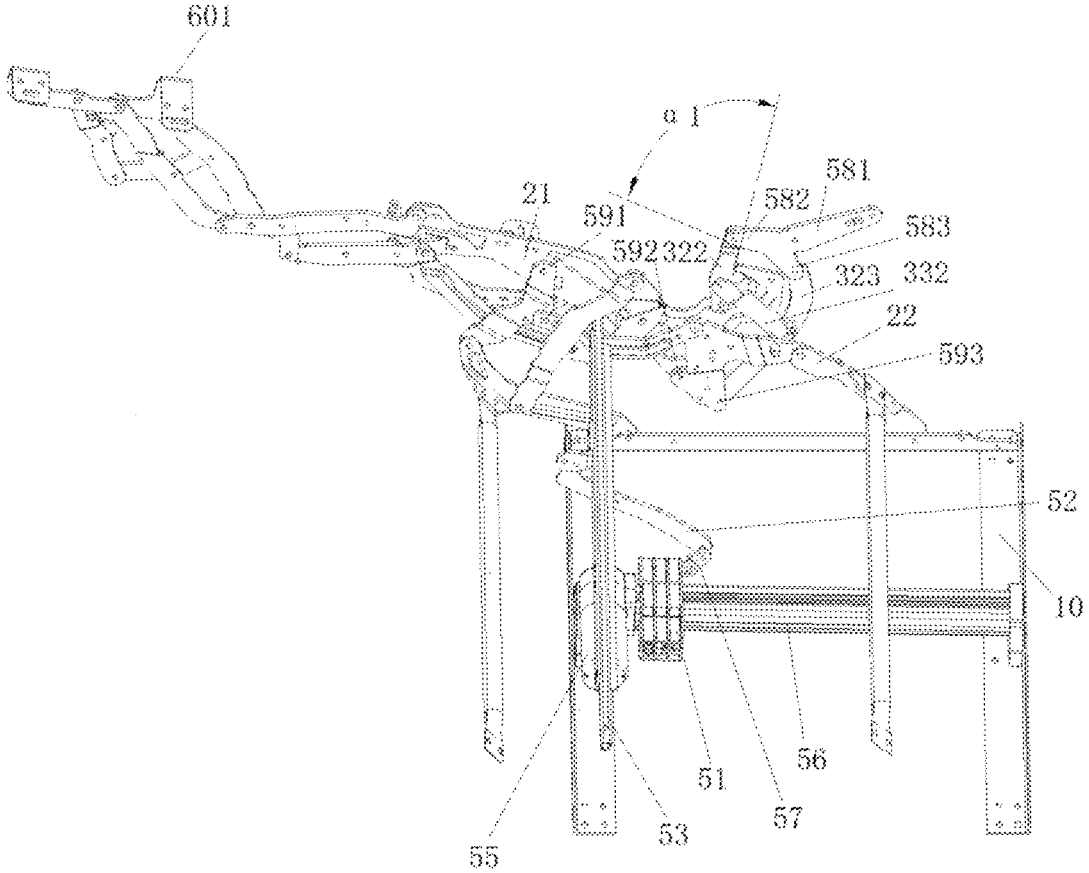
FIG. 9 illustrates a schematic structural diagram of a seat bracket (without an anti-forward-leaning mechanism) according to embodiments of the present disclosure.

In this embodiment, as shown in FIG. 9, the seat bracket further includes a slider 51 and a guide rail 56. The guide rail 56 is disposed on the base 10. The guide rail 56 extends along the horizontal direction. The slider 51 is movably sleeved on the guide rail 56. The driving member 55 is in driving connection with the slider 51. The slider 51 is in transmission connection with the driving rod 53 such that the slider 51 drives the driving rod 53 to move.

Specifically, as shown in FIG. 9, the seat bracket further includes a transmission rod 57 and a driving connecting rod 52. One end of the transmission rod 57 is connected with the slider 51, and the other end of the transmission rod 57 is hinged with one end of the driving connecting rod 52. The other end of the driving connecting rod 52 is hinged with the driving rod 53 such that the driving rod 53 is driven to move by the motion of the slider 51.

Figure 10:
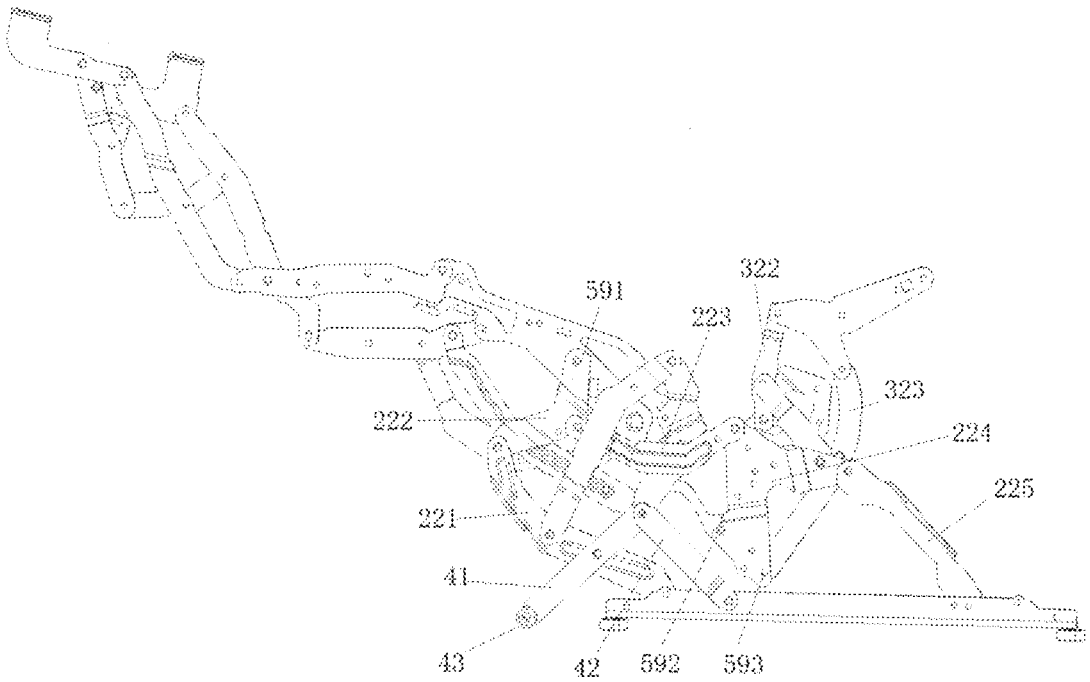
FIG. 10 illustrates a schematic structural diagram of a seat bracket (without a driving member, a driving rod, a slider, a guide rail, a transmission rod, a driving connecting rod and part of base) according to embodiments of the present disclosure.

In this embodiment, as shown in FIG. 10 and FIG. 11, the linkage assembly 22 has a first connecting end 591, a second connecting end 592 and a third connecting end 593. The backrest mechanism 30 includes a second front backrest connecting rod 322, a rear backrest connecting rod 323 and a second pivoting plate 332. Two ends of the second pivoting plate 332 are hinged with the second front backrest connecting rod 322 and the rear backrest connecting rod 323, respectively; one end of the second front backrest connecting rod 322 is hinged with the bracket side plate 21, and the other end of the second front backrest connecting rod 322 is hinged with the backrest mounting plate 31; and one end of the rear backrest connecting rod 323 is hinged with the third connecting end 593 and the other end of the rear backrest connecting rod 323 is hinged with the backrest mounting plate 31, such that the bracket side plate 21 drives, by means of the second front backrest connecting rod 322, the backrest mounting plate 31 to move along a direction of approaching the base 10, causing the bracket side plate 21 to drive, by means of the linkage assembly 22 and the rear backrest connecting rod 323, the backrest mounting plate 31 to move along the direction of approaching the base 10.

Specifically, the second front backrest connecting rod 322 is configured to connect the bracket side plate 21 and the backrest mounting plate 31 in transmission such that the bracket side plate 21 may drive the backrest mounting plate 31 to move. The rear backrest connecting rod 323 is configured to connect the backrest mounting plate 31 and the linkage assembly 22 in transmission such that the linkage assembly 22 may drive the backrest mounting plate 31 to move, thus enabling the bracket side plate 21 to drive the backrest mounting plate 31 to move. The second front backrest connecting rod 322 and the rear backrest connecting rod 323 together guarantee the reliability of the transmission connection between the bracket side plate 21 and the backrest mounting plate 31, ensuring that the seat bracket can be smoothly switched from the TV position to the lying position.

In this embodiment, as shown in FIG. 9 and FIG. 10, the backrest mounting plate 31 includes a first connecting plate segment 581, a second connecting plate segment 582 and a third connecting plate segment 583. A first end of the first connecting plate segment 581, a first end of the second connecting plate segment 582 and a first end of the third connecting plate segment 583 are connected together. The second connecting plate segment 582 and the third connecting plate segment 583 are disposed on two opposite sides of the first connecting plate segment 581, respectively. A second end of the second connecting plate segment 582 is hinged with the second front backrest connecting rod 322. A second end of the third connecting plate segment 583 is hinged with the rear backrest connecting rod 323; and/or when the seat bracket is in the lying position, an included angle between an edge of the second connecting plate segment 582 away from the first connecting plate segment 581 and an edge of the second front backrest connecting rod 322 close to the first connecting plate segment 581 is $\alpha 1$, a value range of $\alpha 1$ being $80° \leq \alpha 1 \leq 88°$.

Specifically, the value range of $\alpha 1$ is $80° \leq \alpha 1 \leq 88°$. Thus, it can be avoided that the backrest mounting plate 31 needs to rotate a large angle to be reclined smoothly, thereby avoiding that the time for switching the seat bracket from the TV position to the lying position is long, helping guaranteeing smooth operation of the seat bracket of the present disclosure and improving the use comfort of the user.

In this embodiment, as shown in FIG. 10, the seat bracket further includes an anti-forward-leaning mechanism 40 that includes a reinforcing member 43, a second anti-forward-leaning rod 42 and a first anti-forward-leaning rod 41. Two ends of the second anti-forward-leaning rod 42 are hinged with the base 10 and a first end of the first anti-forward-leaning rod 41, respectively. A middle of the first anti-forward-leaning rod 41 is hinged with the linkage assembly 22. The reinforcing member 43 is disposed at a second end of the first anti-forward-leaning rod 41. When the seat bracket is in the lying position, the reinforcing member 43 is configured to be abutted against the horizontal mounting base surface.

Specifically, as shown in FIG. 10, the linkage assembly 22 includes a first linkage plate 221, a second linkage plate 222, a third linkage plate 223, a fourth linkage plate 224 and a fifth linkage plate 225. The fourth linkage plate 224 is of an irregular structure and has four different connecting ends. One end of the first linkage plate 221 is hinged with the base 10, and the other end of the first linkage plate 221 is hinged with one end of the second linkage plate 222, and the other end of the second linkage plate 222 forms the first connecting end 591. One end of the third linkage plate 223 is hinged with a middle of the second linkage plate 222, and the other end of the third linkage plate 223 is hinged with one connecting end of the fourth linkage plate 224. Two connecting ends of the fourth linkage plate 224 form the second connecting end 592 and the third connecting end 593, respectively. One connecting end of the fourth linkage plate 224 is hinged with one end of the fifth linkage plate 225, and the other end of the fifth linkage plate 225 is hinged with the base 10.

Specifically, the bracket side plate 21 drives the linkage assembly 22 to move, and the linkage assembly 22 drives the first anti-forward-leaning rod 41 and the second anti-forward-leaning rod 42 to move for unfolding, causing the reinforcing member 43 to move along a direction away from the preset vertical plane until the reinforcing member 43 is abutted against the horizontal mounting base surface to support the seat bracket of the present disclosure. This is equivalent to increasing the support range of the base 10, and risk of forward leaning caused by the gravity moving forwards when the seat bracket is in the lying position can be reduced, helping avoiding tipping of the seat bracket. When the seat bracket is in the sitting position, the second anti-forward-leaning rod 42 and the first anti-forward-leaning rod 41 are collapsed below the seat frame, and the reinforcing member 43 is also collapsed below the seat frame, thereby avoiding exposure of the reinforcing member 43, the second anti-forward-leaning rod 42 and the first anti-forward-leaning rod 41 and guaranteeing the aesthetics of the zero-wall-gap seat.

Specifically, the middle of the first anti-forward-leaning rod 41 is hinged with the middle of the first linkage plate 221. The reinforcing member 43 is a support wheel.

Figure 15:
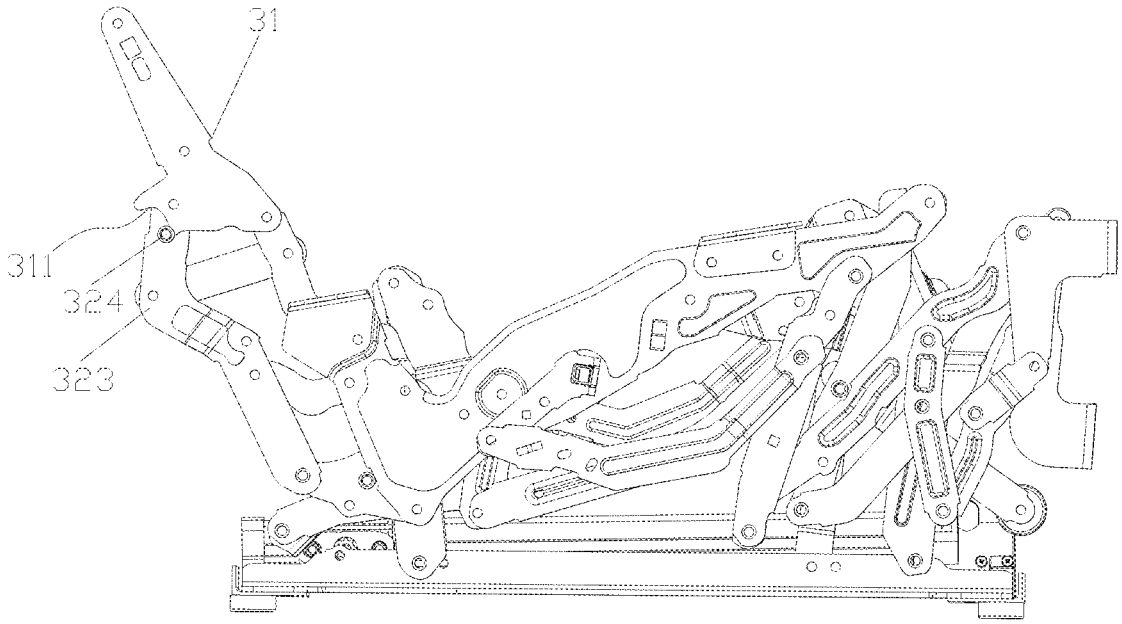
FIG. 15 illustrates a schematic structural diagram of a seat bracket in a sitting position, according to embodiments of the present disclosure.
Figure 16:
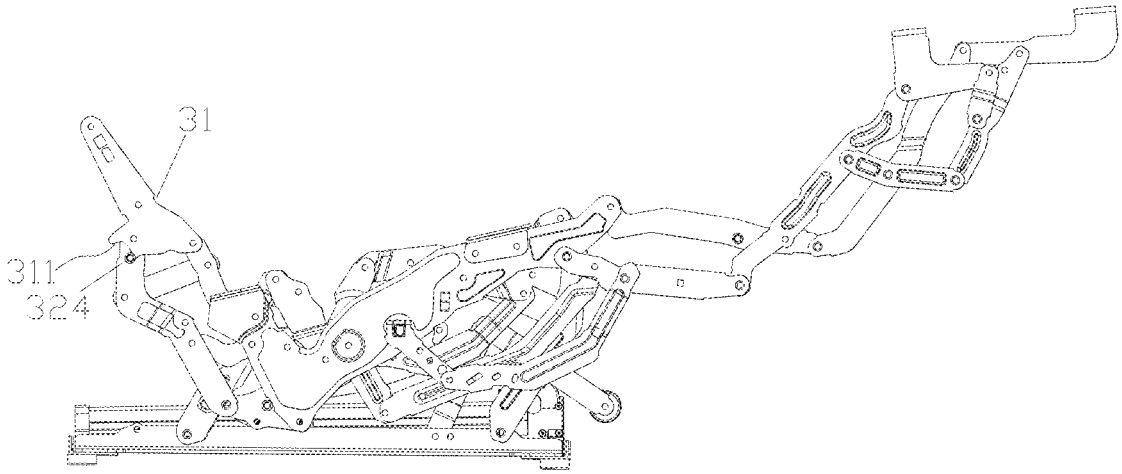
FIG. 16 illustrates a schematic structural diagram of a seat bracket in a TV position according to embodiments of the present disclosure.
Figure 17:
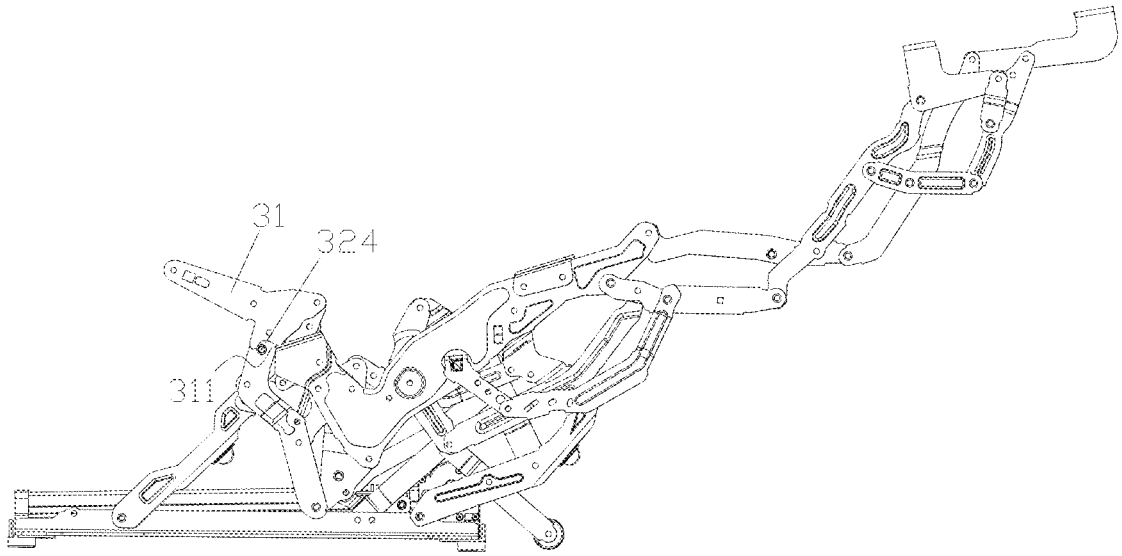
FIG. 17 illustrates a schematic diagram of a seat bracket in a lying position according to embodiments of the present disclosure.

As shown in FIG. 15 to FIG. 17, another embodiment of the present disclosure provides a seat bracket, in this embodiment, a sliding groove may be provided in the backrest mounting plate 31. When the seat bracket is switched between the sitting position, the TV position and the lying position, the limit pin 324 is movably disposed within the sliding groove. When the seat bracket is switched to one of the sitting position, the TV position and the lying position, the limit pin 324 is in limiting fit with an end of the sliding groove to limit the seat bracket in the current position. Specifically, the limit pin 324 is mounted on the rear backrest connecting rod 323, and the sliding groove 311 is provided in an end of the backrest mounting plate 31 facing the rear backrest connecting rod 323. When the backrest mounting plate 31 is retracted to the reset position (in the sitting position and the TV position), the limit pin 324 is abutted against a lower end face of the sliding groove 311. When the backrest mounting plate 31 is unfolded to the reclined position (in the lying position), the limit pin 324 is abutted against an upper end face of the sliding groove 311.

It needs to be noted that, in embodiment as shown in FIG. 1 to FIG. 8 and embodiment as shown in FIG. 15 to FIG. 17 of the present disclosure, the value range of the following parameters of the seat bracket are all the same as those in embodiment as shown in FIG. 9 to FIG. 14: θ1, β1, δ1, β2, δ2, d4, d5, α1.

Figure 18:
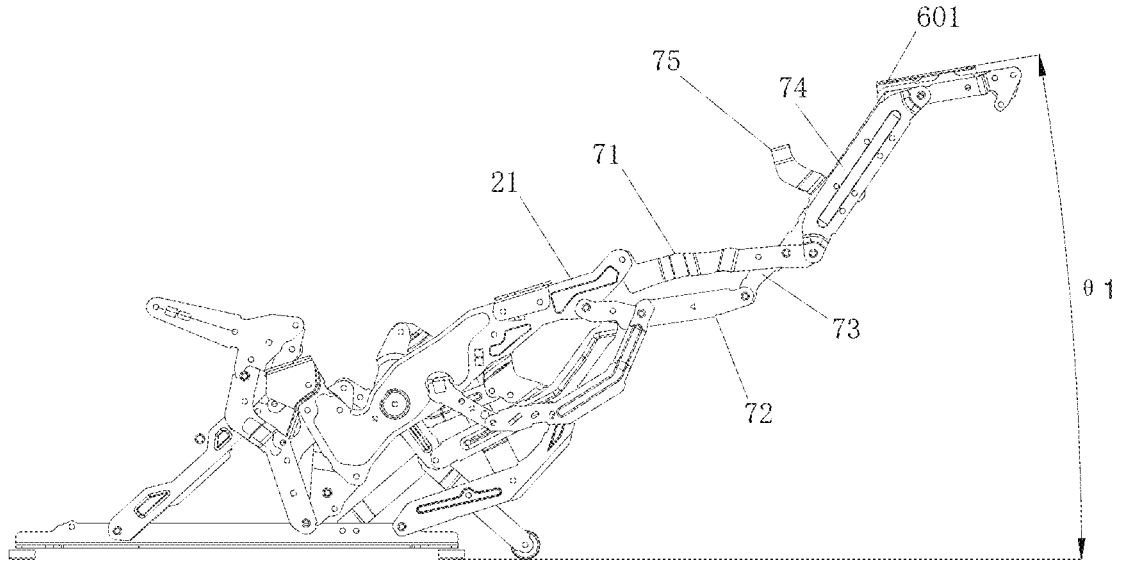
FIG. 18 illustrates a schematic diagram of a seat bracket in a lying position according to another embodiment of the present disclosure.
Figure 19:
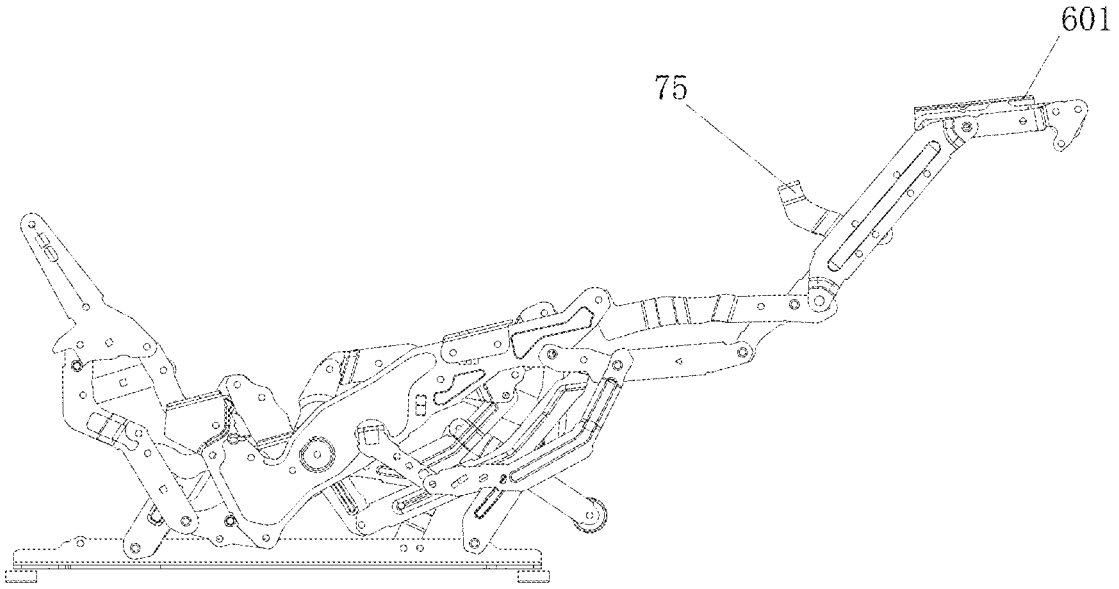
FIG. 19 illustrates a schematic structural diagram of a seat bracket in a TV position according to another embodiment of the present disclosure.

With reference to FIG. 18 and FIG. 19, another embodiment of the present disclosure provides a zero-wall-gap seat. The zero-wall-gap seat provided by this embodiment differs from the zero-wall-gap seat provided by FIG. 9 to FIG. 14 in the following two aspects:

1. There is one footrest 601 in this embodiment, and the footrest 601 in this embodiment is movably connected with the bracket side plate 21 through a first connecting rod 71, a second connecting rod 72, a third connecting rod 73, and a fourth connecting rod 74;
2. The footrest 601 in this embodiment corresponds to the combination of the front footstool 68 and the rear footstool 69 in the embodiment of the zero-wall-gap seat provided in FIG. 9 to FIG. 14. The footrest 601 in this embodiment has all the parameters of the front footstool 68 and the rear footstool 69 in the embodiment of the zero-wall-gap seat provided in FIG. 9 to FIG. 14, and the value range of all the parameters are the same.

In this embodiment, when the seat bracket is in the lying position, a value range of an included angle θ1 between an upper surface of the footrest 601 and the horizontal mounting base surface is 7°≤θ1≤13°, θ1 may be 7°, 8°, 9°, 10°, 11°, 12°, 13° and other values between 7° and 13°; and when the seat bracket is in the TV position, the value range of the included angle θ1 between the upper surface of the footrest 601 and the horizontal mounting base surface is 3° ≤θ1≤9°, θ1 may be 3°, 4°, 5°, 6°, 7°, 8°, 9° and other values between 3° and 9°.

In this embodiment, when the seat bracket is in the lying position, a value range of a height d5 of the highest point of the footrest 601 relative to the horizontal mounting base surface is 560 mm≤d5≤600 mm, d5 may be 560 mm, 570 mm, 580 mm, 590 mm, 600 mm and other values between 560 mm and 600 mm. When the seat bracket is in the TV position, the value range of the height d5 of the highest point of the footrest 601 relative to the horizontal mounting base surface is 450 mm≤d5≤500 mm, d5 may be 450 mm, 460 mm, 470 mm, 480 mm, 490 mm, 500 mm and other values between 450 mm and 500 mm.

It should be noted that the support member 75 in this embodiment is different from the rear footstool 69 in the zero-wall-gap seat provided in FIG. 9 to FIG. 14. In this embodiment, the support member 75 is designed to support the calf.

Another embodiment of the present disclosure further provides a zero-gravity zero-wall-gap seat, including the seat bracket provided above. When the seat is switched from the sitting position to the lying position, the extent of the legs is raised to be 90° to 110°, thereby actuating the legs of the user to change from a vertical state to a raised state. When the sitting position is switched to the lying position, the reclining extent of the backrest is 35° to 45°, causing the back of the user to lean backwards. This enables an iron stand to have the zero gravity function (the legs of the user are slightly higher than the heart or flush with the heart). Also, with the characteristic of the reduced height of the backrest, the backrest is made lower, leading to more significant zero gravity function and better experience.

Specifically, the zero-gravity zero-wall-gap seat includes a seat frame, a footrest cushion, a backrest cushion 232 and the above-mentioned seat bracket.

In a specific implementation, when the seat bracket is in the sitting position, an included angle θ2 between the backrest mounting plate 31 and a preset axis of the bracket side plate 21 is 109°, and a distance h1 between the highest point of the backrest cushion 232 and the horizontal mounting base surface is 915 mm. When the seat bracket is in the TV position, the included angle θ2 between the backrest mounting plate 31 and the preset axis of the bracket side plate 21 is 109°, and a raising height d6 of the highest point of the front footstool 68 away from the horizontal mounting base surface is 505 mm, and a minimum distance d7 between the highest point of the front footstool 68 and the bracket side plate 21 in the horizontal direction is 504 mm. When the seat bracket is in the lying position, the included angle 92 between the backrest mounting plate 31 and the preset axis of the bracket side plate 21 is 140°, the raising height d6 of the highest point of the front footstool 68 away from the horizontal mounting base surface is 623 mm, the distance h1 between the highest point of the backrest cushion 232 and the horizontal mounting base surface is 624 mm, and the minimum distance d7 between the highest point of the front footstool 68 and the bracket side plate 21 in the horizontal direction is 485 mm.

Specifically, an extent to which the back and the legs of the user are close may be limited by limiting the range of the included angle between the backrest mounting plate 31 and the preset axis of the bracket side plate 21. It is avoided that the body of the user is overbent and the experience of the user is affected due to the back and the legs of the user being too close. Meanwhile, it is also avoided that the zero gravity experience of the user is affected due to a too small raising angle of the legs of the user. By limiting the raising height of the highest point of the front footstool 68 away from the horizontal mounting base surface, it can be guaranteed that the legs of the user are slightly higher than the heart, thereby avoiding discomfort due to inversion of the legs while satisfying the zero gravity experience of the user. By limiting the distance between the highest point of the backrest cushion 232 and the horizontal mounting base surface, it can be avoided that the heart of the user is too high or too low. Thus, it can be guaranteed that the legs of the user are slightly higher than the heart, ensuring the use comfort of the user.

From the above description, it can be seen that the above-mentioned embodiments of the present disclosure achieve the following technical effects:

The zero-gravity zero-wall-gap seat of the present disclosure is integrated with three elements, i.e., iron stand landing, zero gravity and zero wall gap, such that the zero-gravity zero-wall-gap seat has the advantages of zero wall gap and zero gravity, is more convenient to place, and more comfortable to use. The seat bracket of the present disclosure is simple in structure and lower in production cost. The seat bracket of the present disclosure is smooth in operation.

When the seat bracket of the present disclosure is in the sitting position, the footrest 601 is retracted below the seat frame, and the highest point of the backrest cushion 232 is in contact with the preset vertical plane. When the seat bracket is in the TV position, compared with the seat bracket being in the sitting position, the distances of the footrest 601 with the seat frame in the horizontal direction and the vertical direction increase such that the footrest 601 is stretched in front of the seat frame and tilted relative to the horizontal direction, and the distance between the highest point of the backrest cushion 232 and the preset vertical plane is greater than zero. When the seat bracket is in the lying position, compared with the seat bracket being in the TV position, the minimum distance between the highest point of the backrest cushion 232 and the preset vertical plane is equal to zero, and the height of the highest point of the footstool assembly 60 relative to the horizontal mounting base surface is greater than the height of the highest point of the backrest mechanism 30 relative to the horizontal mounting base surface. Therefore, the legs of a user can be roughly flush with the heart or slightly higher than the heart, achieving the technical effect of zero gravity. Moreover, since the minimum distance between the highest point of the backrest cushion 232 and the preset vertical plane is equal to zero when the seat bracket is in the sitting position and the lying position, the user does not need to reserve a mounting clearance when mounting the zero-gravity zero-wall-gap seat. Moreover, since the backrest cushion 232 does not interfere with the preset vertical plane when the seat bracket is switched between the sitting position, the TV position and the lying position, zero-wall-gap arrangement of the zero-gravity zero-wall-gap seat can be realized in the present disclosure. Thus, the problem that an iron stand landing zero-gravity zero-wall-gap seat in the prior art cannot meet the requirements of customers on the zero-wall-gap arrangement and the zero-gravity comfort experience of the zero-gravity zero-wall-gap seat is solved, and the zero-gravity zero-wall-gap seat may have the advantages of both zero wall gap and zero gravity, more convenient placement, and more comfort in use.

It should be noted that the terms used herein are merely used for describing the specific implementations, but are not intended to limit the exemplary implementations of the present disclosure. As used herein, the singular form is also intended to include the plural form unless otherwise indicated obviously from the context. Furthermore, it should be further understood that the terms "include" and/or "include" used in this specification specify the presence of stated features, steps, operations, devices, components, and/or a combination thereof.

Unless otherwise specified, the relative arrangement, numerical expressions and numerical values of components and steps set forth in these embodiments do not limit the scope of the present disclosure. Meanwhile, it should be understood that for ease of description, each part in the accompanying drawings is not necessarily drawn to the actual scale. Techniques, methods and apparatuses known to those of ordinary skill in the related art may not be discussed in detail, but where appropriate, the techniques, methods and apparatuses should be considered as part of the description. In all examples shown and discussed herein, any specific value should be interpreted as merely exemplary, rather than restrictive. Therefore, other examples of the exemplary embodiments may have different values. It should be noted that similar reference signs and letters represent similar items in the accompanying drawings below. Therefore, once an item is defined in one drawing, it does not need to be further discussed in subsequent drawings.

It should be understood that, in the description of the present disclosure, terms such as "front" "rear", "upper", "lower", "left", "right", "transverse", "longitudinal", "vertical", "horizontal", "top" and "bottom" indicate orientation or position relationships based on the accompanying drawings. Unless otherwise specified, these terms are merely intended to facilitate or simplify the description of the present disclosure, rather than to indicate or imply that the mentioned device or components must have a specific orientation and must be constructed and operated in a specific orientation. Therefore, they should not be construed as a limitation to the protection scope of the present disclosure. The orientation terms "inner" and "outer" refer to the inner and outer parts relative to the contour of the mentioned component.

For ease of description, spatially relative terms, such as "above", "on the upper side of", "on the upper surface of" and "on", can be used to describe the spatial positional relationship between one component or feature shown in the figure with other components or features. It should be understood that the spatially relative terms are intended to encompass different orientations of the components in use or operation in addition to those shown in the figure. For example, if a component in the figure is inverted, a component described as "above other component or structure" or "on other component or structure" will be then positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Moreover, it needs to be noted that the use of such words as "first" and "second" to define components is merely intended to distinguish between the corresponding components. Unless otherwise stated, such words have no special meaning and thus cannot be construed as limiting the protection scope of the present disclosure.

The foregoing are merely descriptions of the preferred embodiments of the present disclosure, and are not intended to limit the present disclosure. For a person skilled in the art, various modifications and changes may be made to the present disclosure. Any modification, equivalent substitution, improvement and the like made within the spirit and principle of the present disclosure shall all fall in the protection scope of the present disclosure.

What is claimed is:

1. A seat bracket, comprising:

a base;

a linkage mechanism comprising a bracket side plate and a linkage assembly, wherein the linkage assembly is hinged with the base and the bracket side plate is hinged on the linkage assembly; and a backrest mechanism comprising a backrest mounting plate, a backrest pivoting assembly and a limiting plate, wherein the backrest pivoting assembly comprises a first front backrest connecting rod, a second front backrest connecting rod and a rear backrest connecting rod; a lower end of the first front backrest connecting rod is hinged with the bracket side plate; an upper end of the first front backrest connecting rod is hinged with a lower end of the second front backrest connecting rod; an upper end of the second front backrest connecting rod is hinged with a front end of the backrest mounting plate; a lower end of the rear backrest connecting rod is hinged with the linkage assembly; and an upper end of the rear backrest connecting rod is hinged with a rear end of the backrest mounting plate;

wherein the backrest mounting plate has a reclined position tilted backwards relative to the base and a reset position reset relative to the base; and the limiting plate is capable of forming a four-connecting rod mechanism with the backrest pivoting assembly and/or the bracket side plate to limit a motion range of the backrest mounting plate between the reclined position and the reset position.

2. The seat bracket according to claim 1, wherein the limiting plate comprises a first pivoting plate; a front end of the first pivoting plate is hinged with the bracket side plate; and a rear end of the first pivoting plate is hinged with the rear backrest connecting rod.

3. The seat bracket according to claim 2, wherein the limiting plate further comprises a second pivoting plate; a front end of the second pivoting plate is hinged with the second front backrest connecting rod; a rear end of the second pivoting plate is hinged with the rear backrest connecting rod; and a rear end of the first pivoting plate is located below the rear end of the second pivoting plate.

4. The seat bracket according to claim 3, wherein the backrest pivoting assembly further comprises a limit pin disposed on the second front backrest connecting rod; when the backrest mounting plate is in the reclined position, the limit pin is abutted against the backrest mounting plate; and when the backrest mounting plate is located in the reset position, the limit pin is abutted against the second pivoting plate.

5. The seat bracket according to claim 3, wherein the backrest pivoting assembly further comprises a limit pin disposed on the rear backrest connecting rod; a sliding groove is provided in an end of the backrest mounting plate facing the rear backrest connecting rod; when the backrest mounting plate is in the reclined position, the limit pin is abutted against a lower end face of the sliding groove; and when the backrest mounting plate is located in the reset position, the limit pin is abutted against an upper end face of the sliding groove.

6. The seat bracket according to claim 1, further comprising an anti-forward-leaning mechanism that comprises a first anti-forward-leaning rod and a second anti-forward-leaning rod, wherein an upper end of the first anti-forward-leaning rod is hinged with an upper end of the second anti-forward-leaning rod; a middle of the first anti-forward-leaning rod is hinged with a front end of the linkage assembly; a lower end of the second anti-forward-leaning rod is hinged with the base; and when the backrest mounting plate is in the reclined position, a lower end of the first anti-forward-leaning rod is in contact with a ground.

7. The seat bracket according to claim 1, wherein when the backrest mounting plate is in the reclined position, an included angle between the second front backrest connecting rod and a seat frame mounting surface of the bracket side plate is between 40° and 70°.

8. The seat bracket according to claim 1, wherein when the backrest mounting plate is in the reclined position, a distance between the front end of the backrest mounting plate and a lower surface of the base is between 260 mm and 300 mm.

9. The seat bracket according to claim 1, wherein the linkage assembly comprises a first linkage plate, a second linkage plate, a third linkage plate, a fourth linkage plate and a fifth linkage plate; a lower end of the first linkage plate is hinged with the base; an upper end of the first linkage plate is hinged with a front end of the second linkage plate; a rear end of the second linkage plate is hinged with the bracket side plate; a front end of the third linkage plate is hinged with a middle of the second linkage plate; a rear end of the third linkage plate is hinged with a front end of the fourth linkage plate; a lower end of the fourth linkage plate is hinged with a lower end of the bracket side plate; a rear end of the fourth linkage plate is hinged with the rear backrest connecting rod; an upper end of the fourth linkage plate is hinged with an upper end of the fifth linkage plate; and a lower end of the fifth linkage plate is hinged with the base.

10. The seat bracket according to claim 1, further comprising:

a driving mechanism, the driving mechanism comprises a driving member, a slider, a driving connecting rod and a driving rod, wherein the driving member is in driving connection with the slider to drive the slider to move along a front-rear direction of the base; the driving connecting rod extends along the front-rear direction of the base; the driving rod extends along a left-and-right direction of the base; the slider is hinged with a lower end of the driving connecting rod; an upper end of the driving connecting rod is hinged with the driving rod; the driving rod is in driving connection with the bracket side plate; in a process of the driving member driving the slider to slide, the slider is capable of driving the driving connecting rod to rotate, thereby moving the driving rod forwards and upwards; the driving rod drives, by the bracket side plate and the linkage assembly, the backrest mounting plate to move from the reset position to the reclined position; and/or a footstool assembly, the footstool assembly comprises an inner stool plate, an outer stool plate, a front stool plate, a rear stool plate, a first front stool connecting rod, a second front stool connecting rod, a rear stool connecting rod, a front footstool and a rear footstool, wherein a rear end of the outer stool plate is hinged with the bracket side plate; a front end of the outer stool plate is hinged with a rear end of the rear stool plate; a rear end of the inner stool plate is hinged with the bracket side plate; a front end of the inner stool plate is hinged with a rear end of the front stool plate; a middle of the inner stool plate is hinged with a middle of the rear stool plate; a rear end of the first front stool connecting rod is hinged with the middle of the rear stool plate; a middle of the first front stool connecting rod is hinged with a middle of the front stool plate; a front end of the first front stool connecting rod is hinged with a rear end of the second front stool connecting rod; the front footstool is connected with a front end of the front stool plate and a front end of the second front stool connecting rod, respectively; a lower end of the rear stool connecting rod is hinged with a middle of the second front stool connecting rod; and the rear footstool is separately hinged with a front end of the rear stool plate and an upper end of the rear stool connecting rod.

11. The seat bracket according to claim 1, comprising:

two linkage mechanisms, the base is disposed on a horizontal mounting base surface, and the two linkage mechanisms are disposed on two opposite sides of the base, respectively;

the bracket side plate is configured to be connected with a seat frame of a zero-wall-gap seat; the seat bracket further comprises a footstool assembly; the footstool assembly and the backrest mechanism are both movably connected with the bracket side plate; the footstool assembly comprises a footrest; the backrest mounting plate is configured to be connected with a backrest cushion of the zero-wall-gap seat;

the seat bracket has a sitting position, a TV position and a lying position; the bracket side plates of each of the two linkage mechanisms is disposed movably such that the seat bracket can be reciprocally switched between the sitting position, the TV position and the lying position;

wherein when the seat bracket is in the sitting position, the footrest is retracted below the seat frame, and a minimum distance between a highest point of the backrest cushion and a preset vertical plane is equal to zero; when the seat bracket is in the TV position, the footrest is stretched in front of the seat frame and tilted relative to a horizontal direction, and a distance between the highest point of the backrest cushion and the preset vertical plane is greater than zero; when the seat bracket is in the lying position, compared with the seat bracket being in the TV position, the highest point of the backrest cushion is lowered down, and the minimum distance between the highest point of the backrest cushion and the preset vertical plane is equal to zero; and a height of a highest point of the footstool assembly relative to the horizontal mounting base surface is greater than a height of a highest point of the backrest mechanism relative to the horizontal mounting base surface.

12. The seat bracket according to claim 11, wherein when the seat bracket is in the lying position, a value range of an included angle $\theta 1$ between an upper surface of the footrest and the horizontal mounting base surface is $7° \leq \theta 1 \leq 13°$; and when the seat bracket is in the TV position, the value range of the included angle $\theta 1$ between the upper surface of the footrest and the horizontal mounting base surface is $3° \leq \theta 1 \leq 9°$.

13. The seat bracket according to claim 12, wherein two footrests are provided, one of the two footrests is a rear footstool and the other one of the two footrests is a front footstool; a highest point of the front footstool is higher than a highest point of the rear footstool, and a height of the highest point of the rear footstool relative to the horizontal mounting base surface is greater than a height of a highest point of the backrest mounting plate relative to the horizontal mounting base surface; the value range of the included angle $\theta 1$ between the upper surface of the front footstool and the horizontal mounting base surface is $7° \leq \theta 1 \leq 12°$; and when the seat bracket is in the TV position, the value range of the included angle $\theta 1$ between the upper surface of the front footstool and the horizontal mounting base surface is $3° \leq \theta 1 \leq 7°$.

14. The seat bracket according to claim 11, wherein when the seat bracket is in the lying position, a value range of an included angle $\beta 1$ between the backrest mounting plate and the horizontal mounting base surface is $15° \leq \beta 1 \leq 30°$; in a process of the seat bracket being switched from the sitting position to the lying position, a value range of an angle variation $\delta 1$ of the included angle $\beta 1$ between the backrest mounting plate and the horizontal mounting base surface is $25° \leq \delta 1 \leq 50°$, wherein $\delta 1 = \beta 1_{sitting\ position} - \beta 1_{lying\ position}$.

15. The seat bracket according to claim 11, wherein when the seat bracket is in the lying position, a value range of an included angle $\beta 2$ of a preset axis of the bracket side plate and the horizontal mounting base surface is $13° \leq \beta 2 \leq 19°$; when the seat bracket is in the sitting position, the value range of the included angle $\beta 2$ of the preset axis of the bracket side plate and the horizontal mounting base surface is $6° \leq \beta 2 \leq 12°$; when the seat bracket is in the TV position, the value range of the included angle $\beta 2$ of the preset axis of the bracket side plate and the horizontal mounting base surface is $10° \leq \beta 2 \leq 15°$; and in a process of the seat bracket being switched from the sitting position to the lying position, a value range of an angle variation $\delta 2$ of the included angle $\beta 2$ of the preset axis of the bracket side plate and the horizontal mounting base surface is $3° \leq \delta 2 \leq 13°$.

16. The seat bracket according to claim 13, wherein the footstool assembly comprises a rear stool plate and a front stool plate; one end of the rear stool plate and one end of the front stool plate are both hinged with the bracket side plate; the other end of the rear stool plate is hinged with the rear footstool; the other end of the front stool plate is hinged with the front footstool; wherein when the seat bracket is in the lying position and the TV position respectively, a value range of a maximum distance d4 between the rear footstool and the front footstool is 210 mm≤d4≤270 mm; when the seat bracket is in the lying position, a value range of a height d5 of the highest point of the rear footstool relative to the horizontal mounting base surface is 560 mm≤d5≤600 mm; and when the seat bracket is in the TV position, the value range of the height d5 of the highest point of the rear footstool relative to the horizontal mounting base surface is 450 mm≤d5≤500 mm.

17. The seat bracket according to claim 11, wherein when the seat bracket is in the lying position, a value range of a height d5 of a highest point of the footrest relative to the horizontal mounting base surface is 560 mm≤d5≤600 mm; and when the seat bracket is in the TV position, the value range of the height d5 of the highest point of the footrest relative to the horizontal mounting base surface is 450 mm≤d5≤500 mm.

18. The seat bracket according to claim 11, further comprising a driving member and a driving rod, wherein the driving rod is movably penetrated through the bracket side plate; the driving rod is in transmission connection with the footstool assembly; the driving member is in driving connection with the driving rod to drive the driving rod to move such that the driving rod drive the bracket side plate to move, causing the seat bracket to reciprocally switch between the sitting position, the TV position and the lying position; wherein before the bracket side plate moves a first preset distance d1 forwards, the driving rod is disposed rotatably about an axis of the driving rod and disposed movably along the horizontal direction such that the driving rod drive the footrest to move, causing the seat bracket to switch from the sitting position to the TV position; and before the bracket side plate continues to move a second preset distance d2 forwards, the driving rod is disposed movably along the horizontal direction to drive the bracket side plate and the backrest mounting plate to move, causing the seat bracket to switch from the TV position to the lying position.

19. The seat bracket according to claim 11, wherein the linkage assembly has a first connecting end, a second connecting end and a third connecting end; the limiting plate comprises a second pivoting plate; two ends of the second pivoting plate are hinged with the second front backrest connecting rod and the rear backrest connecting rod, respectively; and an end of the rear backrest connecting rod is hinged with the third connecting end such that the bracket side plate drives, by the second front backrest connecting rod, the backrest mounting plate to move along a direction of approaching the base, causing the bracket side plate to drive, by the linkage assembly and the rear backrest connecting rod, the backrest mounting plate to move along the direction of approaching the base.

20. A zero-wall-gap seat, comprising the seat bracket according to claim 1.

* * * * *